US006488146B1

(12) United States Patent
Dotsikas

(10) Patent No.: US 6,488,146 B1
(45) Date of Patent: Dec. 3, 2002

(54) MULTI-DOSE DISPOSABLE MEDICANT AND FLUID CONTAINER

(76) Inventor: Michael Dotsikas, 7 Cedar Creek Hollow, Lake Ronkonkoma, NY (US) 11779

( * ) Notice: Subject to any disclaimer, the term of this patent is extended or adjusted under 35 U.S.C. 154(b) by 0 days.

(21) Appl. No.: 09/655,353

(22) Filed: Sep. 5, 2000

(51) Int. Cl.[7] ..... B65D 77/00
(52) U.S. Cl. ..... 206/217; 206/219; 383/33
(58) Field of Search ..... 206/216, 217, 206/218, 219, 222, 532, 828, 484; 383/33; 426/115

(56) References Cited

U.S. PATENT DOCUMENTS 2,766,796 A * 10/1956 Tupper ..... 220/521
3,077,262 A * 2/1963 Gaste ..... 206/221
3,730,337 A * 5/1973 White ..... 206/568
3,939,972 A * 2/1976 Mayworm ..... 206/219
4,324,338 A * 4/1982 Beall ..... 206/217
4,326,575 A * 4/1982 Larkin ..... 220/660
4,637,061 A * 1/1987 Riese ..... 383/38
4,776,455 A * 10/1988 Anderson et al. ..... 206/0.5
4,856,651 A * 8/1989 Francis, Jr. ..... 206/219
4,923,702 A * 5/1990 Powell et al. ..... 206/19
4,927,012 A * 5/1990 Rowe ..... 206/219
5,044,774 A * 9/1991 Bullard et al. ..... 383/34.1
5,075,119 A * 12/1991 Mendenhall ..... 426/113
5,088,838 A * 2/1992 Yeh ..... 383/33
6,047,817 A * 4/2000 Taylor et al. ..... 206/217
6,245,367 B1 * 6/2001 Galomb ..... 426/115

* cited by examiner

*Primary Examiner*—Mickey Yu
*Assistant Examiner*—Jila M. Mohandesi
(74) *Attorney, Agent, or Firm*—Michael Kroll

(57) ABSTRACT

The present invention 10 discloses a disposable container 12 for holding suitable fluid 24 to be used for consuming a medicinal pill 28. In one embodiment, a disposable plastic package 60 is disclosed having a fluid chamber 62 and a pill chamber 64 having a divide therebetween. A tear-away strip 68 is disclosed for access into the fluid chamber 62 along with a thin wire frame 72 for adding support to the fluid container. In other embodiments, the container 12 also contains variously designed means 20, 36, 48 for housing the pills 28. The container 12 may have multiple compartments 42, 44, 46 for holding liquids 24. Also, the pills 28 may be housed in a handle cavity 20 or base cavity 36 enclosed by a seal 22, 38. Alternatively, a pill cup 48 is provided having a tear strip 54 thereon for being releasably attached to the base 30 of container 12. Also, an alternative design discloses a top 56 attached to the container 12 by a tear strip 54 wherein the container 12 has a thin wire frame 58 around its upper rim for strength and ease of use.

3 Claims, 26 Drawing Sheets

MULTI-DOSE DISPOSABLE MEDICANT AND FLUID CONTAINER

BACKGROUND OF THE INVENTION

1. Field of the Invention

The present invention relates generally to containers and, more specifically, to a container having means for holding a predetermined amount of pills in a segregated manner from a portion of the container having a predetermined amount of liquid which is used to swallow the pills.

The liquid portion of the container conforms substantially to a cup having removable sealing means to ensure the freshness of the contents and to provide a tamperproof compartment.

Further the liquid portion having a base and sidewalls can be divided into a plurality of compartments each having individually removable sealed covers.

The pills can be contained in a variety of ways such as individual blister packs formed within the handle member whereby pressing on one side of the blister compartment will provide access through the other side.

Further the pills can be contained in blister packs which are formed in a container base periphery flange member whereby pressing on one side of the blister pack will provide access through the other side.

In addition the pills can be contained in a second cup which is releasably sealed to the base of the liquid cup portion. Thereby providing a second sanitary useable cup such as may be necessary when dealing with children.

2. Description of the Prior Art

There are other pill-containing device designed for providing a tamperproof package, as well as insuring the freshness of the pill. Typical of these is U.S. Pat. No. 3,920,120 issued to Shveda on Nov. 18, 1975.

Another patent was issued to Hilderbrand on Dec. 16, 1975 as U.S. Pat. No. 3,926,361.

Yet another U.S. Pat. No. 4,397,804 was issued to Austin on Jun. 14, 1983 and still yet another was issued on Nov. 22, 1983 to Beall as U.S. Pat. No. 4,416,370.

Another patent was issued to Howes on Dec. 31, 1991 as U.S. Pat. No. 5,076,433.

U.S. Pat. No. 3,920,120

Inventor: Andrew P. Shveda

Issued: Nov. 18, 1975

A combination package for a primary product and a secondary product complementary to the primary product. The combination package is of the type having a tubular sidewall member and a bottom closure member attached to the sidewall member. The bottom closure member is spaced apart from the lower most portion of the sidewall member to define a secondary product containment volume. A secondary product is placed in this volume and held in place with a retaining means such as a glue spot or a film of material over the end of the sidewall member. The secondary product may be placed in position at the time of manufacture of the package.

U.S. Pat. No. 3,926,361

Inventor: Henry R. Hilderbrand

Issued: Dec. 16, 1975

A handle member fixed to the outside of a container to a position extending radially from the container and utilizable as a handle. A napkin holder affixed to the outside of the container spaced from the handle member releasably supports a napkin.

U.S. Pat. No. 4,387,804

Inventor: John J. Austin

Issued: Jun. 14, 1983

A package for containing a preselected amount of a product in the form of a pill or the like is adapted to be converted for use as a cup for containing liquid and includes a pair of sidewalls made of paperboard which are joint together along three mutual edges thereof, the fourth mutual edges defining the top of the cup. A support flap is connected by a perforated score line along an edge of the sidewalls at the top of the cup and has a plastic blister bonded to one face thereof within which a pill or other product may be contained. The support flap is provide with an aperture therein registering with the interior of the blister and a flangible closure, preferably a metal foil, is secured in overlaping relationship to the aperture to prevent loss of the product prior to the time of use. Spaced folded lines in the sidewalls allow folding of the package to a compact condition for storage, and the support flap may be torn away from the top of the cup during use to allow ready access to the product.

U.S. Pat. No. 4,416,370

Inventor: Robert Beall

Issued: Nov. 22, 1983

A compartmented container suited for use in conjunction with administering the sacramental elements during a communion service and for taking medication and like substances comprising a body member having first and second ends and a side wall portion extending therebetween, a central opening extending through the body member, a floor disposed at an intermediate location along the side wall portion and extending across the central opening separating the body member into first and second compartments, the first compartment being substantially cup-like in form to hold a liquid therein, a closed wall member extending from the floor member into the second compartment forming a cavity therewithin for receiving and storing a communion wafer, a pill or tablet, or other non liquid substance therein, the closed wall member being spaced inwardly from the side wall portion of the body member forming a space therebetween, and a separate closure member slidably receivable within the second compartment including a closed wall member shaped to be movable in the space formed between the side wall portion of the body member and the closed wall member forming the cavity, the closure member having a rupturable membrane extending there across adjacent one end thereof and being positionable within the second compartment such that the membrane extends across and closes the cavity, the closure member being movable in the second compartment against the cavity forming wall member ruptures the membrane and provides access to the no liquid substance stored within the cavity.

U.S. Pat. No. 5,076,433

Inventor: James O. Howes

Issued: Dec. 31, 1991

In the present invention, food product containers, holders, wrappers or instruments are constructed in a manner which enables these products to secretly retain a prize award, while being indistinguishable from non-prize bearing products. In this way, the prize-bearing product may be randomly distributed with conventional, non-prize bearing products, without having the existence of a prize award being discovered before opening by the consumer. By creating a prize retaining zone which is secretly and undiscoverably embedded in conventional food delivery products such as cups, straws, holders, containers, etc., prize awards such as cash, are secretly hidden and randomly distributed to lucky customers who instantly win the prize award.

While these pill containing device designed for providing tamperproof packaging, as well as insuring the freshness of the pill may be suitable for the purposes for which they were designed, they would not be as suitable for the purposes of the present invention, as hereinafter described.

SUMMARY OF THE PRESENT INVENTION

The present invention discloses a disposable container for holding suitable fluid to be used for consuming a medicinal pill. In one embodiment, a disposable plastic package is disclosed having a fluid chamber and a pill chamber having a divide therebetween. A tear-away strip is disclosed for access into the fluid chamber along with a thin wire frame for adding support to the fluid container. In other embodiments, the container also contains variously designed means for housing the pills. The container may have multiple compartments for holding liquids. Also, the pills may be housed in a handle cavity or base cavity enclosed by a seal. Alternatively, a pill cup is provided having a tear strip thereon for being releasably attached to the base of container. Also, an alternative design discloses a top attached to the container by a tear strip wherein the container has a thin wire frame around its upper rim for strength and ease of use.

A primary object of the present invention is to provide a pill container having a predetermined amount of liquid to help swallow the pills.

Another object of the present invention is to provide a pill container having a predetermined amount of fluid having a tamperproof releasable seal forming the cover of the pill container.

Yet another object of the present invention is to provide a pill container having a segregated portion comprised of a base member and sidewalls for containing an amount of liquid therein and having a releasable tamperproof seal.

Still yet another object of the present invention is to provide a pill container having a segregated container portion comprised of a base member and sidewalls having a number of partitions therein providing a plurality of segregated liquid containers, each having a releasable tamperproof seal.

Another object of the present invention is to provide a pill container having a predetermined amount of fluid having a tamperproof releasable seal forming the cover of the pill container and having a plurality of pills contained in blister packs which form an integral part of a handle.

Yet another object of the present invention is to provide a pill container having a predetermined amount of fluid having a tamperproof releasable seal forming the cover of the pill container and having a plurality of pills contained within a second detachable container having a base member and sidewalls attached to the first container in columnar fashion having a second tamperproof releasable seal.

Yet another object of the present invention is to provide a pill container comprised of two cup-like containers being removably sealed together wherein one container having one or more partitions therein having one or more releasable seals providing access to a predetermined amount of liquid held within said container or said partitioned portions of said container which will be used to swallow the pills contained in the second container which can also serve as a second cup once the pills are removed.

Additional objects of the present invention will appear as the description proceeds.

The present invention overcomes the shortcomings of the prior art by providing a container having means for holding a predetermined amount of pills in a segregated manner from a portion of the container having a predetermined amount of liquid which is used to swallow the pills.

The liquid portion of the container conforms substantially to a cup having removable sealing means to ensure the freshness of the contents and to provide a tamperproof compartment.

Further the liquid portion having a base and sidewalls can be divided into a plurality of compartments each having individually removable sealed covers.

The pills can be contained in a variety of ways such as individual blister packs formed within the handle member whereby pressing on one side of the blister compartment will provide access through the other side.

Further the pills can be contained in blister packs which are formed in a container base periphery flange member whereby pressing on one side of the blister pack will provide access through the other side.

In addition the pills can be contained in a second cup which is releasably sealed to the base of the liquid cup portion. Thereby providing a second sanitary useable cup such as may be necessary when dealing with children.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
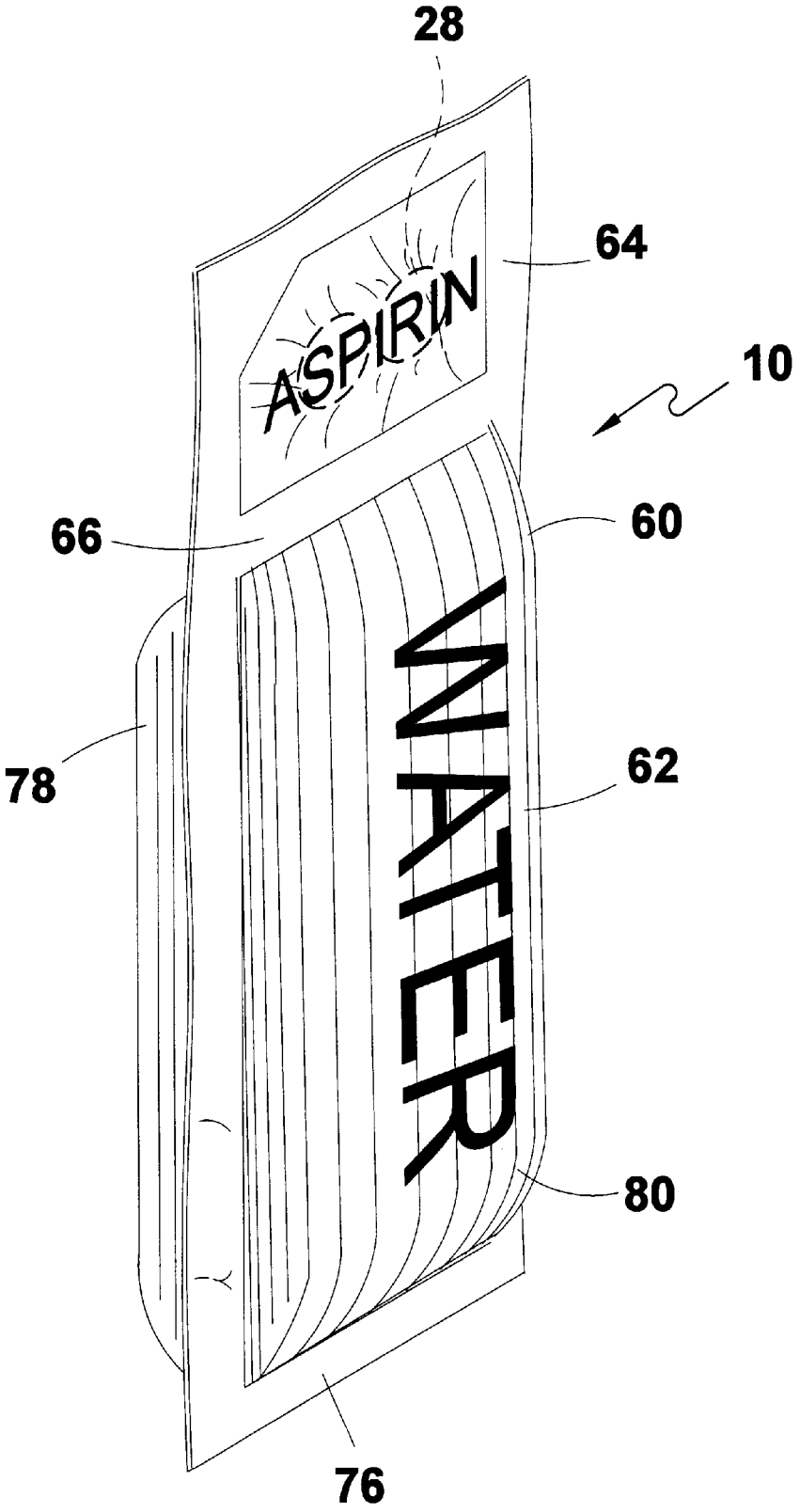
FIG. 1 is a perspective view of the present invention.

With regard to reference numerals used, the following numbering is used throughout the drawings.

10 present invention
12 container
14 cup seal
16 pull tab
18 handle
20 handle cavity
22 handle seal
24 liquid
26 fingers of hand
28 pill
30 base
32 walls
34 flange base
36 base cavities
38 base seal
40 partition
42 first liquid section
44 second liquid section
46 third liquid section
48 pill cup
50 pull string
52 tamper proof cover
54 tear strip
56 top
58 thin wire frame
60 container
62 fluid chamber
63 pill chamber
66 divide
68 tear away strip
70 lower end of fluid chamber
72 thin wire frame
73 spillway
76 heat seal
78 shell of container
80 shell of container
82 tear line
84 opening

DESCRIPTION OF THE PREFERRED EMBODIMENT(S)

In order that the invention may be more fully understood, it will now be described, by way of example, with reference to the accompanying drawings in which FIGS. 1 through 26 illustrate the present invention being a multi-dose disposable medication and fluid container.

Turning to FIG. 1, therein is shown a perspective view of the present invention 10 showing a hermetically sealed container 60 having contained therein in a first chamber 62 a pre-determined amount of fluid in a segregated manner from another portion 64 of the container 60 having a plurality of pills 28 contained therein. Container 60 is a disposable plastic pack consisting of a pair of shells 78, 80 having opposing concavities with the edges of the shells being heat sealed 76 having two chambers 62, 64 separated by a divide 66.

Figure 2:
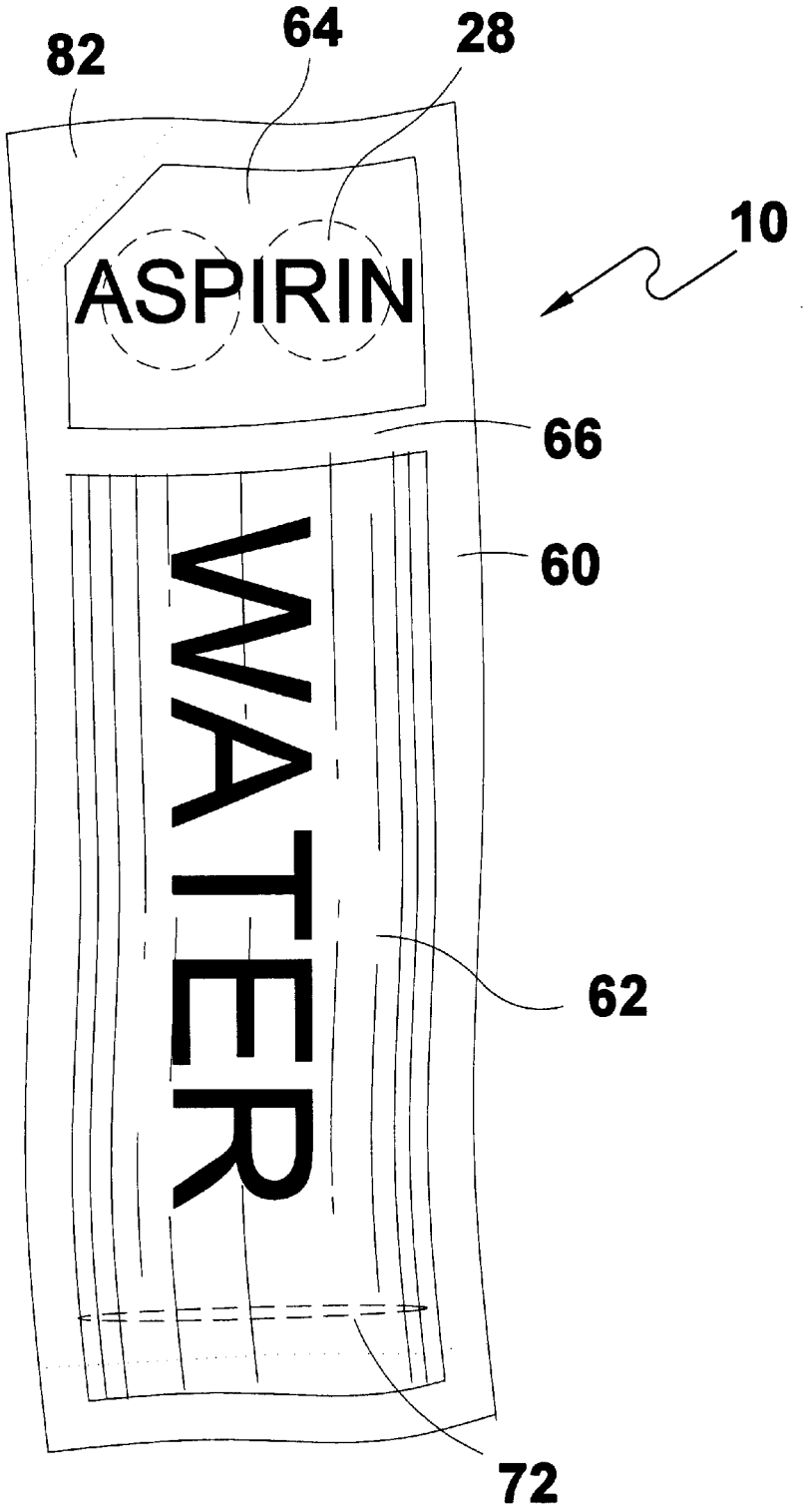
FIG. 2 is a front perspective view of the present invention.

Turning to FIG. 2, therein is shown a front perspective view of the present invention 10 showing a hermetically sealed container 60 having contained therein in a first chamber 62 a pre-determined amount of fluid in a segregated manner from another portion 64 of the container 60 having a plurality of pills 28 contained therein. Container 60 is a disposable plastic pack having two chambers 62, 64 separated by a divide 66. A tear line 82 is shown in the corner of the container 60. A thin wire frame 72 is also shown.

Figure 3:
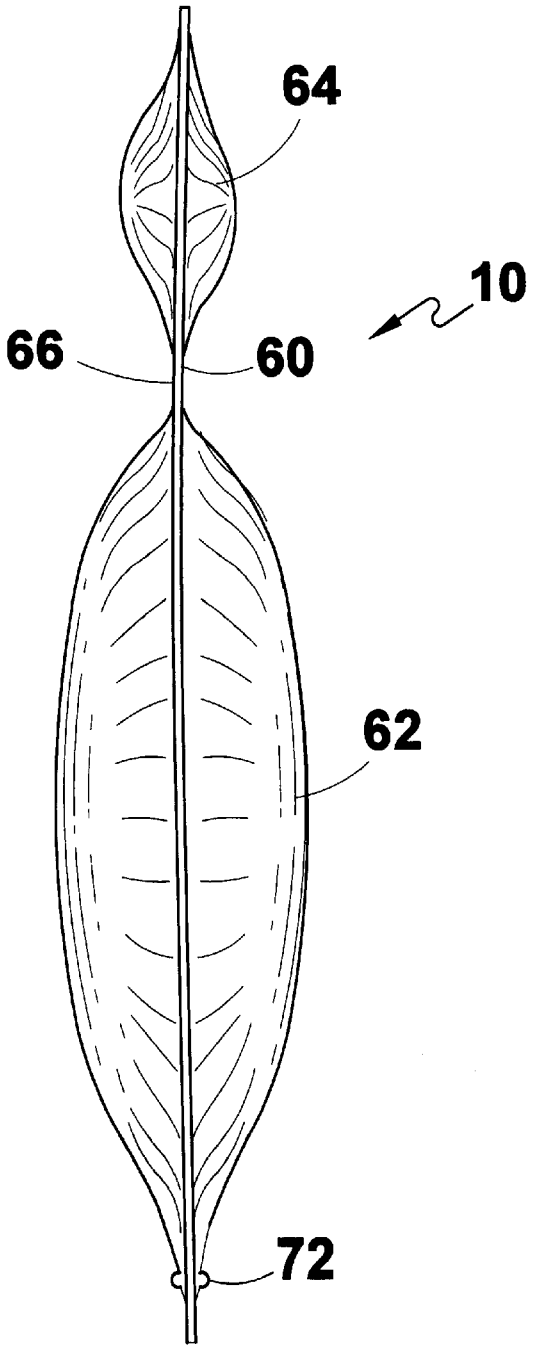
FIG. 3 is a side perspective view of the present invention.

Turning to FIG. 3, therein is shown a side perspective view of the present invention 10 showing a hermetically sealed container 60 having contained therein in a first chamber 62 a pre-determined amount of fluid in a segregated manner from another portion 64 of the container 60 having a plurality of pills 28 contained therein. Container 60 is a disposable plastic pack having two chambers 62, 64 separated by a divide 66. A thin wire frame is also shown.

Figure 4:
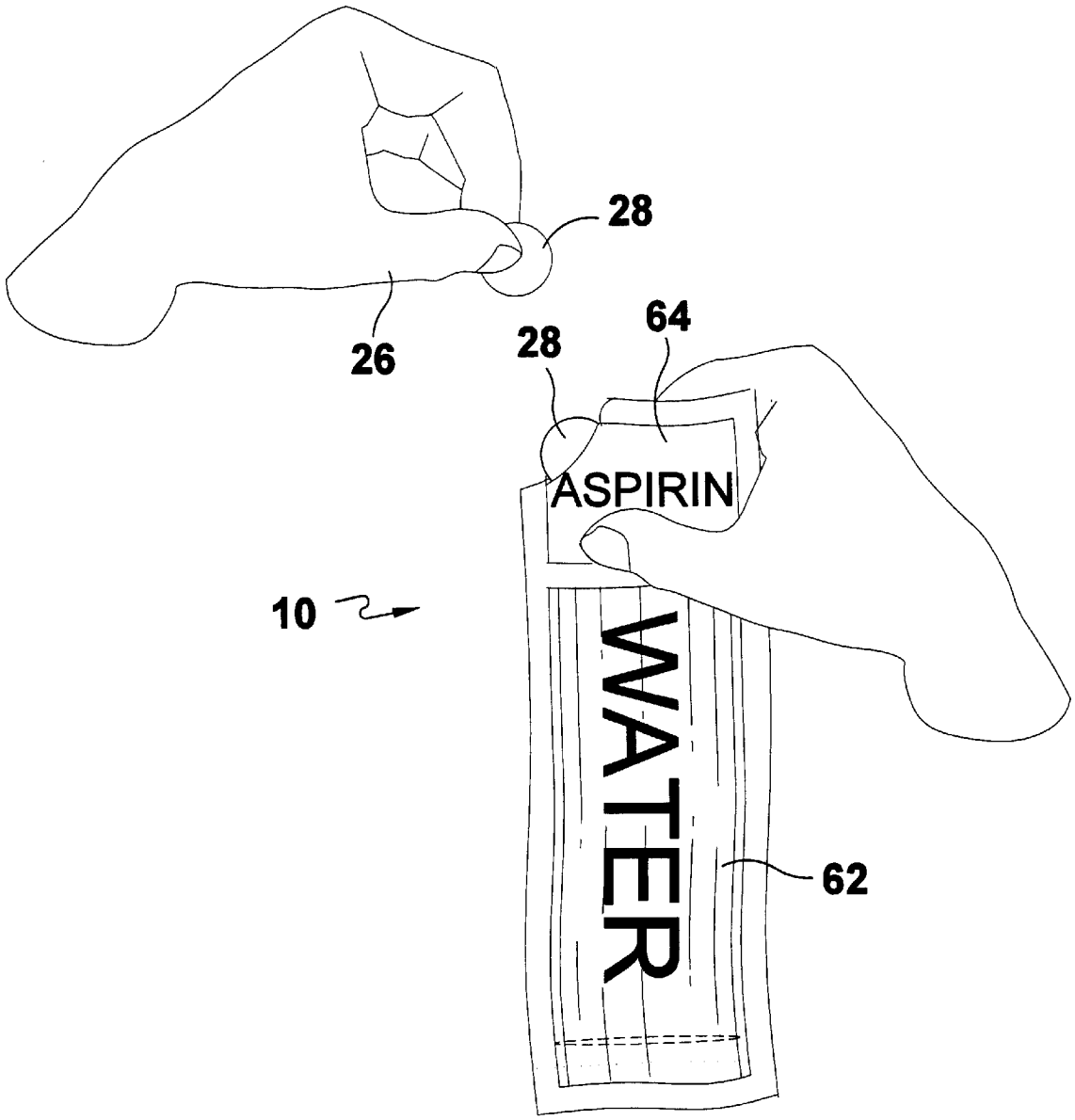
FIG. 4 is a perspective view of the present invention showing a pill being removed.

Turning to FIG. 4, therein is shown an illustration whereby the present invention 10 has a fluid containing chamber 62 and a pill containing chamber 64 attached thereto. Shown are fingers 26 having a corner of the pill chamber 64 removed which will permit access to the pills 28 contained in the pill chamber 64.

Figure 5:
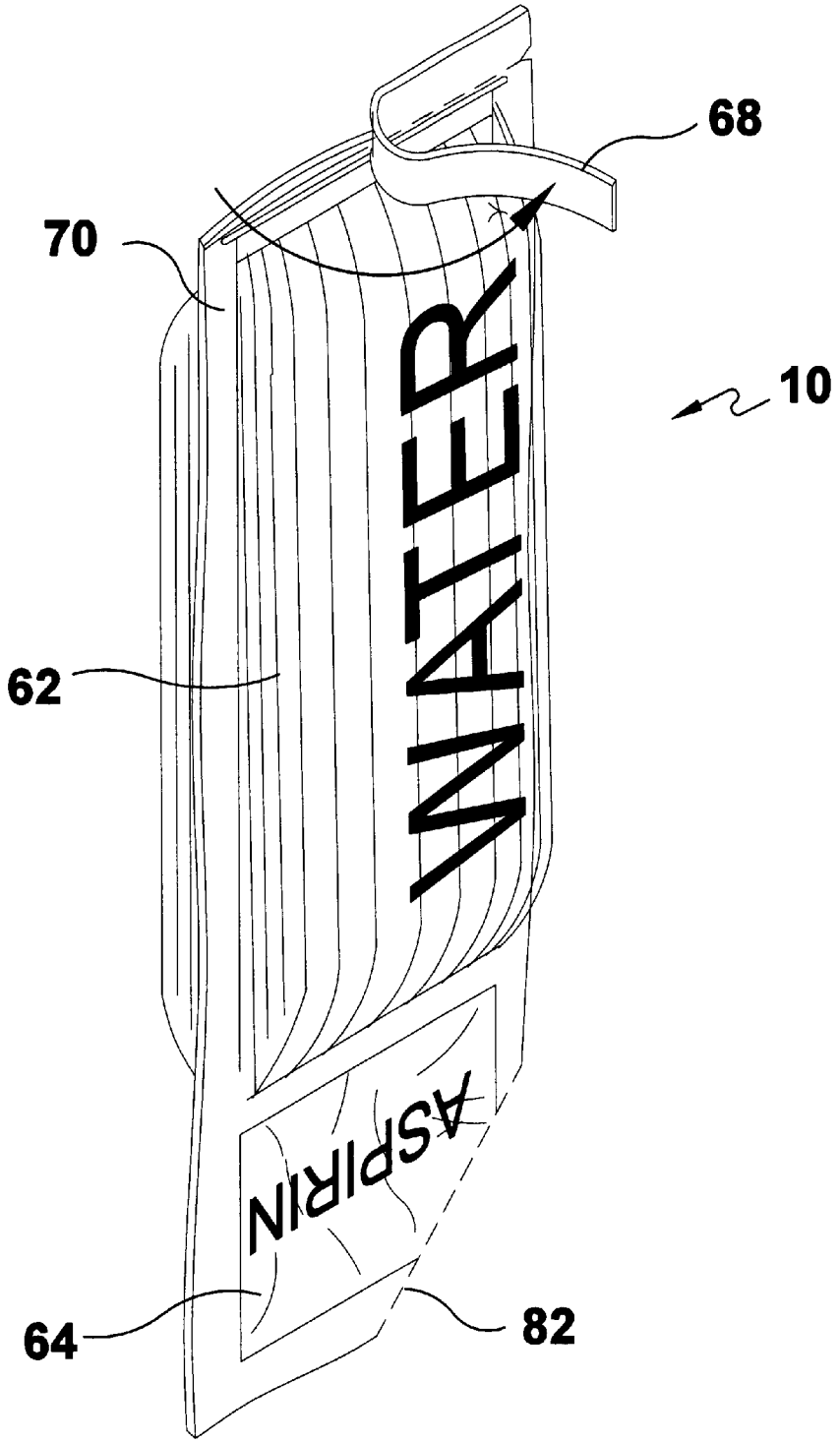
FIG. 5 is a perspective view of the present invention showing a tear-away strip.

Turning to FIG. 5, therein is shown a perspective view of the lower portion of the present invention 10 having a fluid containing chamber 62 and a pill containing chamber 64 wherein the pills having been removed from pill chamber 64 along tear line 82. Shown is a tear-away strip 68 attached to the lower end 70 of the fluid chamber 62 whereby access into the liquid contained in the fluid chamber 62 is obtained.

Figure 6:
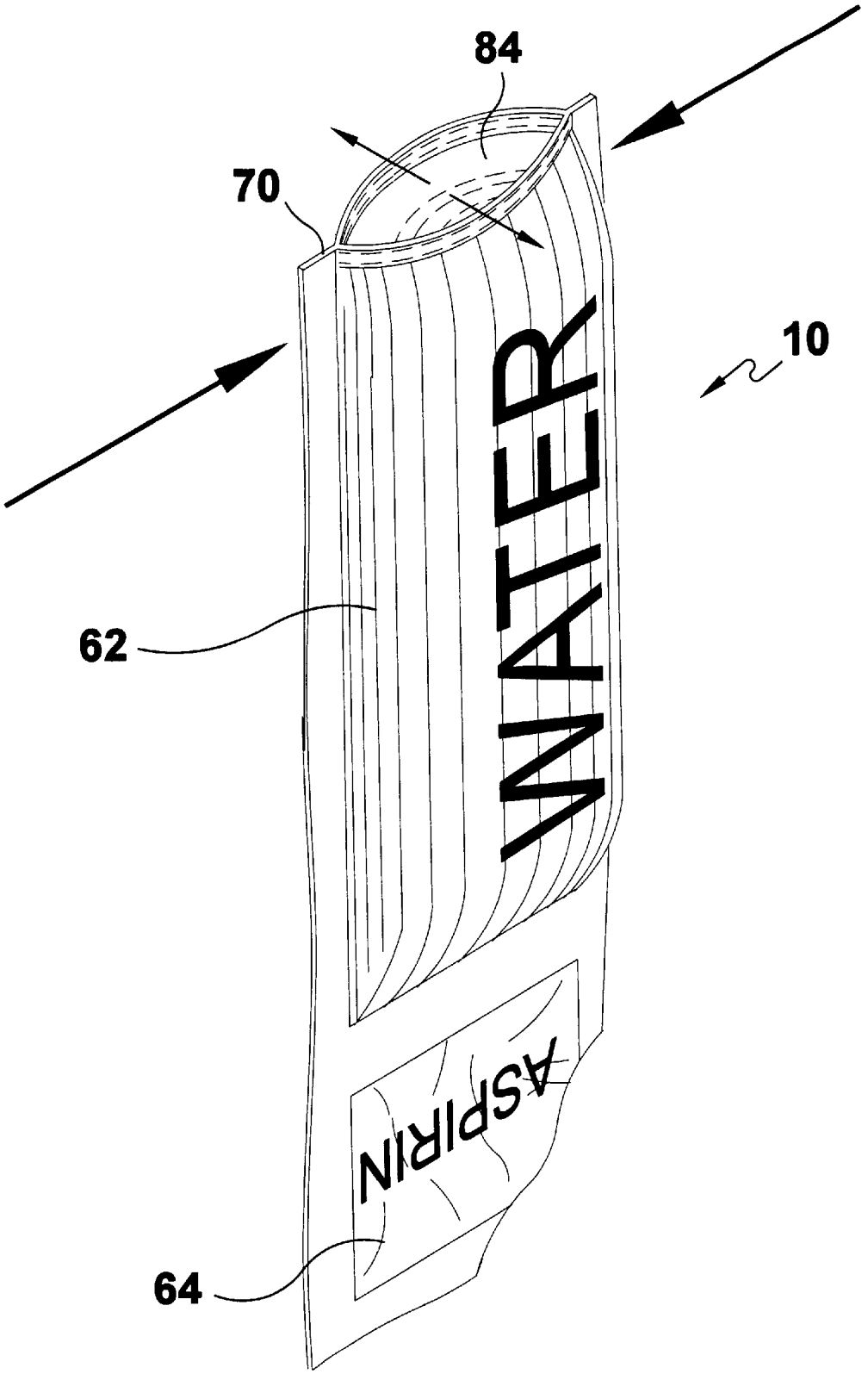
FIG. 6 is a continuation of the illustration shown in FIG. 5.

Turning to FIG. 6, therein is shown a perspective view of the lower portion of the present invention 10 having a fluid containing chamber 62 and a pill containing chamber 64 wherein the pills having been removed from pill chamber 64. Shown is an opening 84 in the lower end 70 of the fluid chamber 62 whereby access into the liquid contained in the fluid chamber 62 is obtained by removal of the tear strip (not shown).

Figure 7:
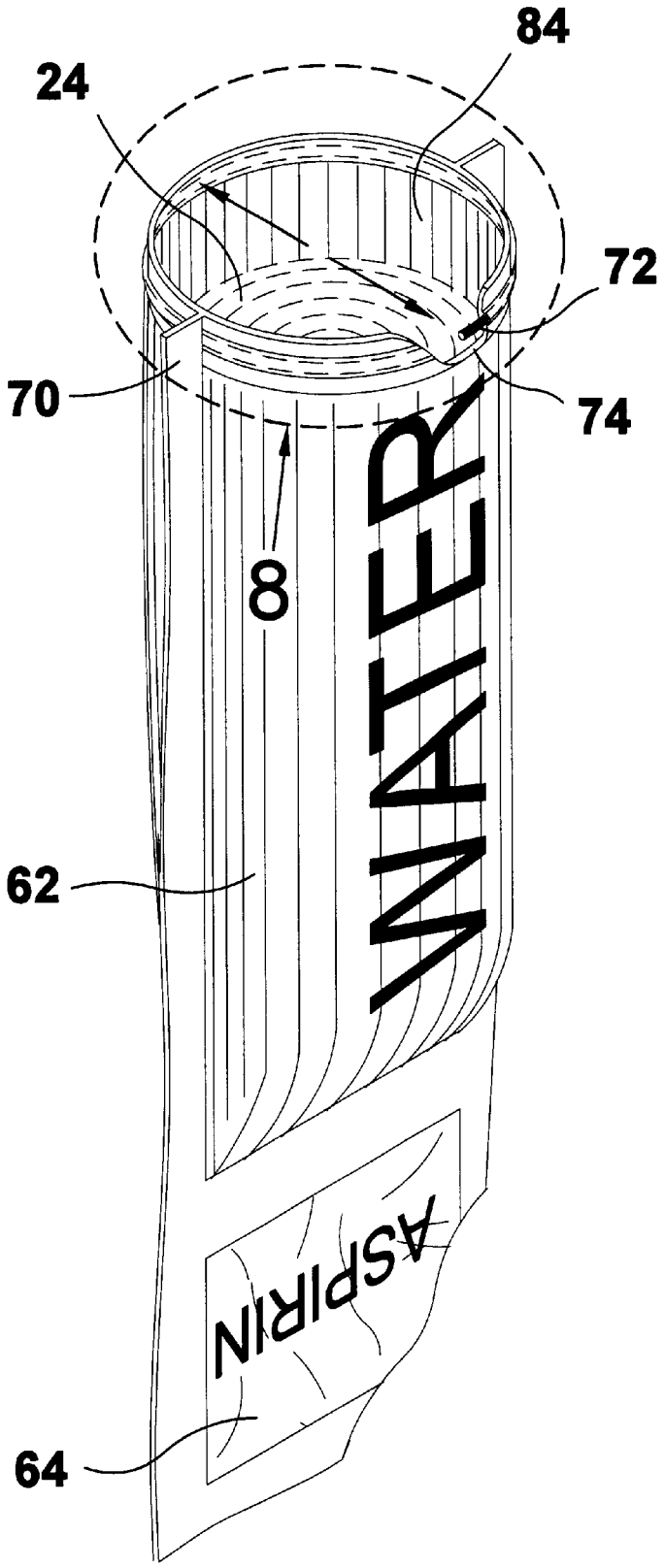
FIG. 7 is a continuation of the illustration shown in FIG. 6.

Turning to FIG. 7, therein is shown a perspective view of the lower portion of the present invention 10 having a fluid containing chamber 62 and a pill containing chamber 64 wherein the pills having been removed from pill chamber 64. Shown is an opening 84 in the lower end 70 of the fluid chamber 62 whereby access into the liquid 24 contained in the fluid chamber 62 is obtained. Also shown is a rigid thin wire frame 72 extending circumferentially around the lower rim 70 of fluid chamber 62 for providing structural support to fluid chamber 62 which allows the user to more easily sip the liquid 24 contained therein along with a spillway 74 over which the fluid 24 passes.

Figure 8:
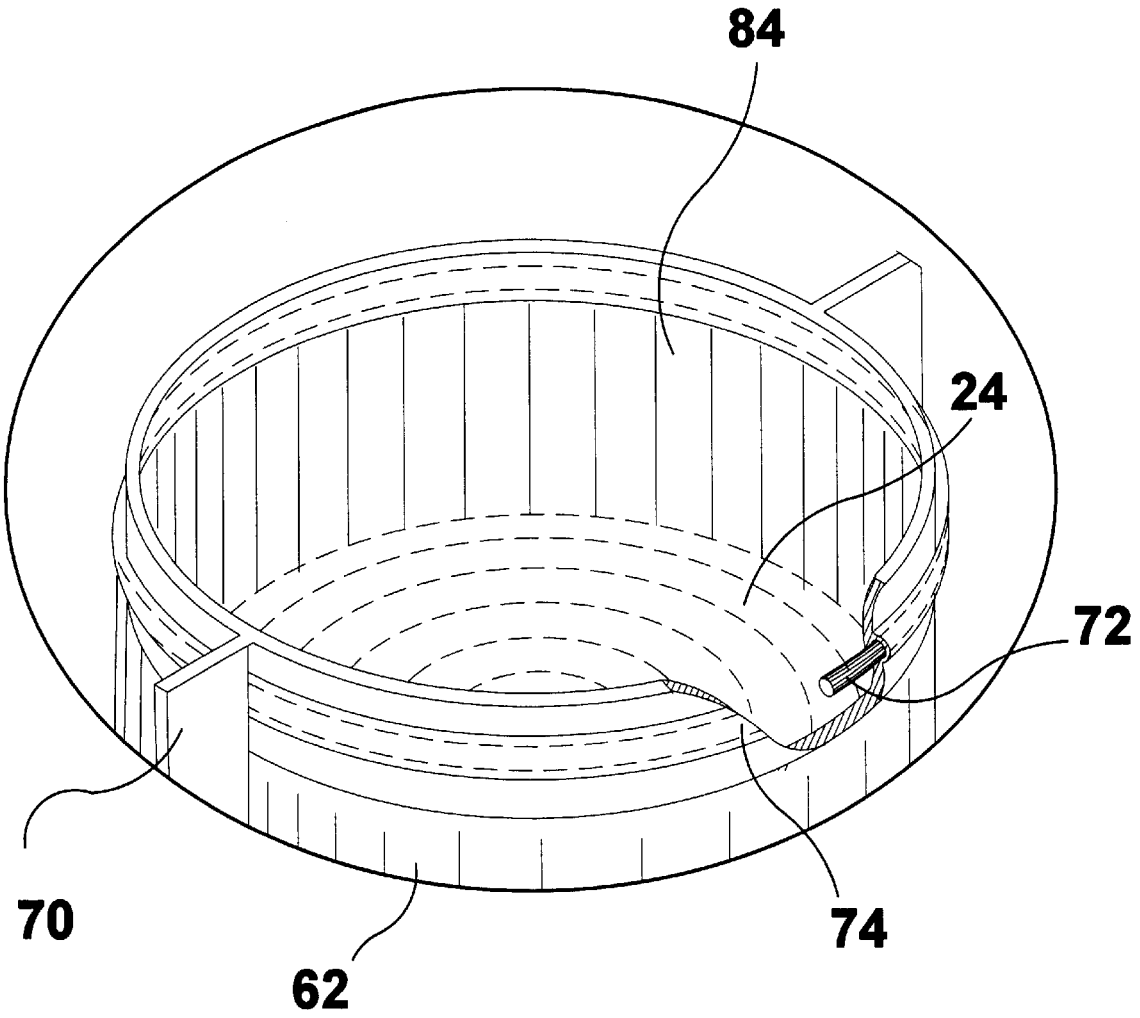
FIG. 8 is an illustration of the lower end of the present invention.

Turning to FIG. 8, therein is shown a perspective view of the lower portion of the present invention 10 having a fluid containing chamber 62. Shown is an opening 84 in the lower end 70 of the fluid chamber 62 whereby access into the liquid 24 contained in the fluid chamber 62 is obtained. Also shown is a rigid thin wire frame 72 extending circumferentially around the lower rim 70 of fluid chamber 62 for providing structural support to fluid chamber 62 which allows the user to more easily sip the liquid 24 contained therein along with a spillway 74 over which the fluid 24 passes.

Figure 9:
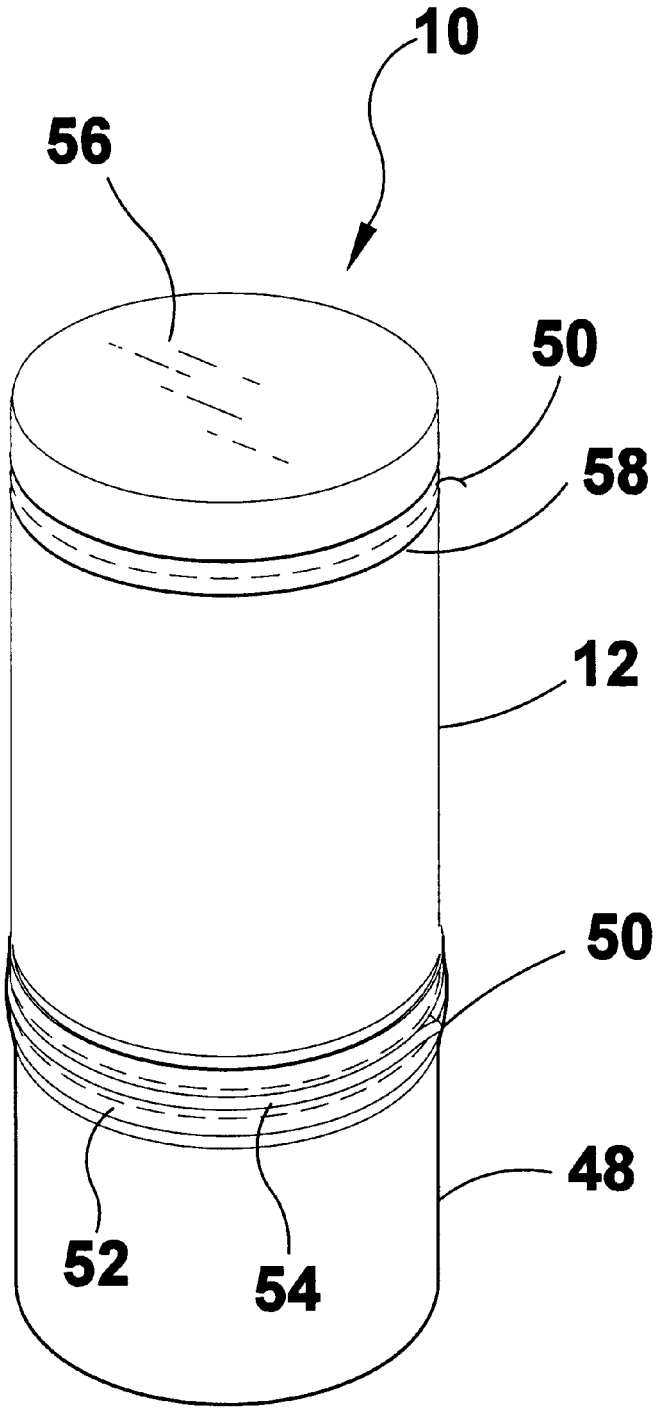
FIG. 9 is a perspective view of the present invention being a cup-like container having a predetermined amount of water hermetically sealed within said container having a removable upper top having a pull tab for removing the upper top.

Turning to FIG. 9, shown therein is a perspective view of the present invention 10.

Shown is a cup-like container 12 having a predetermined amount of water hermetically sealed within the container 12 having a removable top 56 having a pull string 50 for removing the upper top 56. The liquid portion of the container 12 conforms substantially to a cup having a removable sealing top means 56 with container 12 having a thin wire frame 58 thereon to ensure the freshness of the contents and to provide a tamperproof compartment. A plurality of pills are contained in a second lower cup 48, as shown in the illustration, which is releasably sealed to the underside of the base of the liquid cup portion 12, thereby providing a second sanitary useable cup 48 such as may be necessary when dealing with children. The pill cup 48 and top 56 are releasably attached to the main cup 12 by a tear strip 54 having a pull string 50 releasing member having a plastic tamper proof cover 52.

Figure 10:
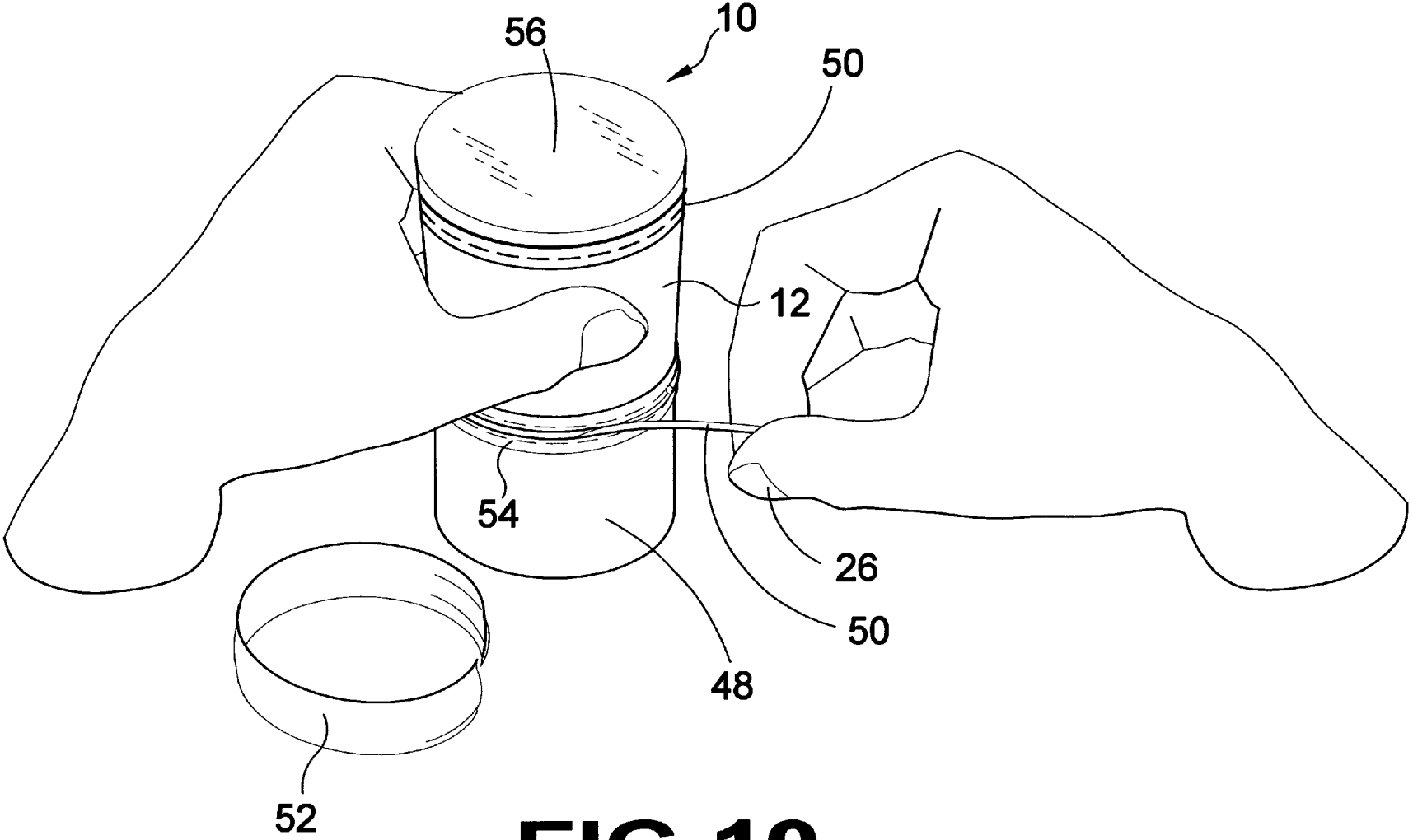
FIG. 10 is a continuation of the illustration as shown in FIG. 9, wherein the present invention has a fluid containing member which is releaseably sealed to a second attached cup-like member along with and upper top. Shown is the plastic tamperproof cover removed which provides access to a tear strip which will permit separation of the two cup-like containers and access to the pills contained therein.

Turning to FIG. 10, shown therein is a continuation of the illustration as shown in FIG. 9, whereby the present invention 10 having a fluid containing member 12 is releaseably attached to a first upper cup top 56 and a lower second attached cup-like member 48. Shown are fingers 26 with the plastic tamperproof cover 52 removed which provides access to a tear strip 54 with pull string 50 which will permit separation in the standard mariner of the two cup-like containers 12, 48 and access to the pills contained therein. A second pull string 50 assists in attaching the top 56 to container 12.

Figure 11:
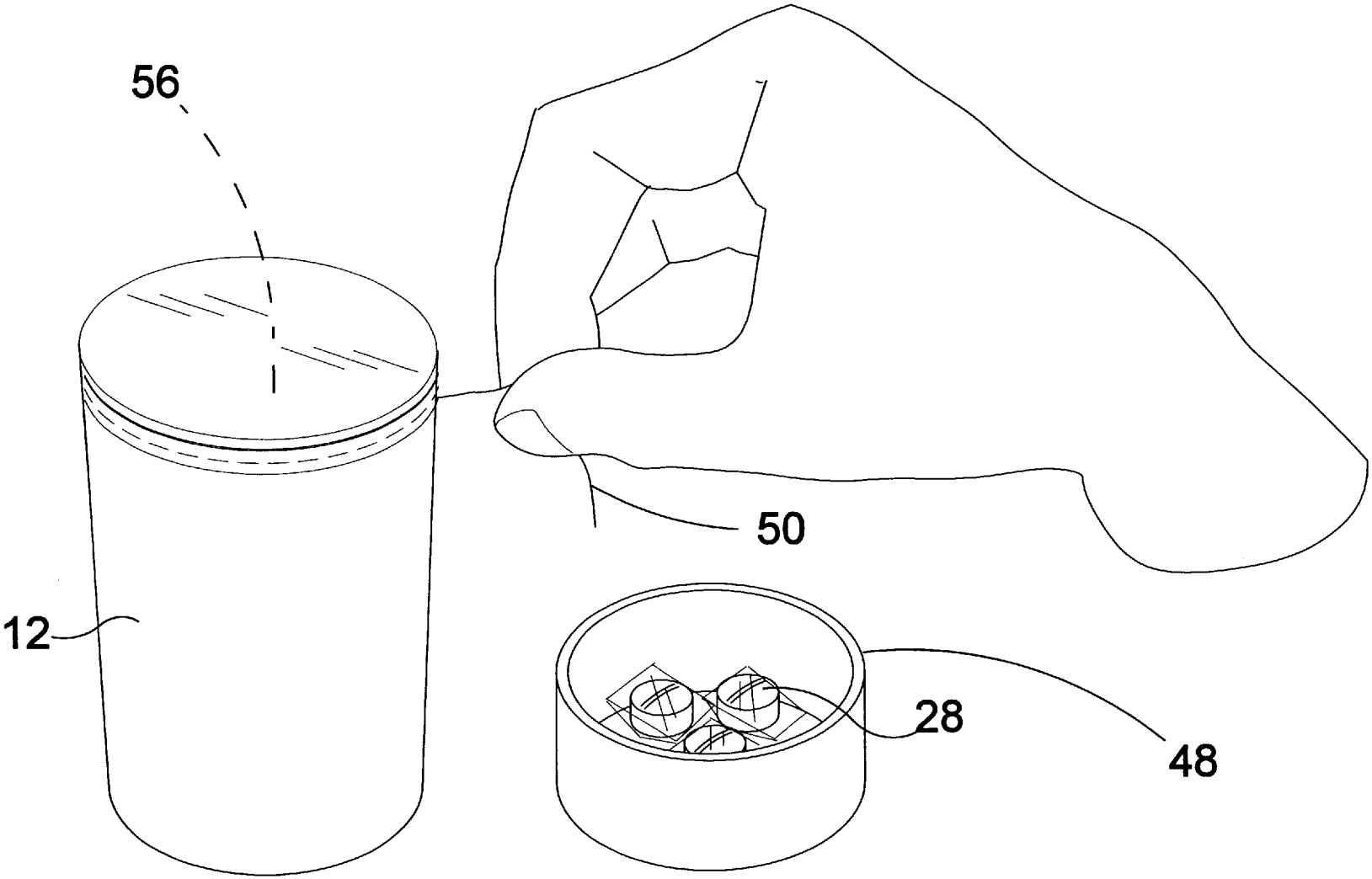
FIG. 11 is a continuation of the illustration as shown in FIG. 10, whereby the attached cup-like containers are separated. One of the cup-like members has a plurality of pills contained therein. Also shown is the hermetically sealed liquid container having the removable upper top being removed by the pull tab providing access to the liquid contained therein.

Turning to FIG. 11, shown therein is a continuation of the illustration as shown in FIG. 10, whereby the attached cup-like containers 12, 48 are separated. One of the cup-like members 48 has a plurality of pills 28 contained therein. Also shown is the hermetically sealed liquid container 12 having the upper top 56 being removed by the pull string 50 providing access to the liquid contained therein.

Figure 12:
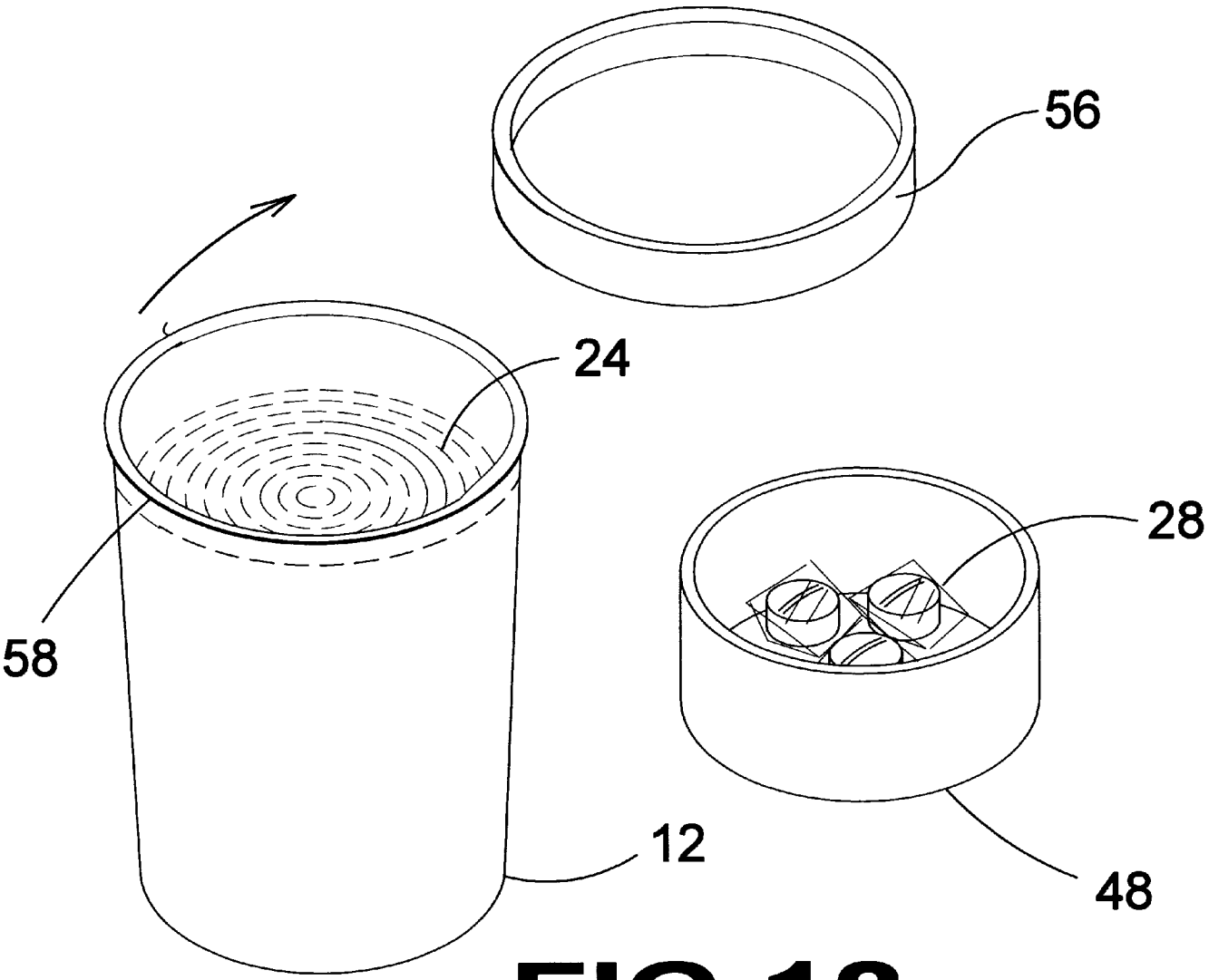
FIG. 12 is a perspective view of the present invention with the upper top and lower pill container removed from the liquid containing container. The lower cup-like member has a plurality of pills contained therein.

Turning to FIG. 12, shown therein is a continuation of the illustration as shown in FIG. 11, whereby the attached cup-like containers 12, 48 and top 56 are separated. One of the cup-like members 48 has a plurality of pills 28 contained therein. Also shown is the hermetically sealed liquid container 12 having the top 56 removed providing access to the liquid 24 contained therein. Also shown is the rigid thin wire frame 58 extending circumferentially around the upper rim of cup 12 for providing structural support to cup 12 which also allows a user to more easily sip the liquid 24.

Figure 13:
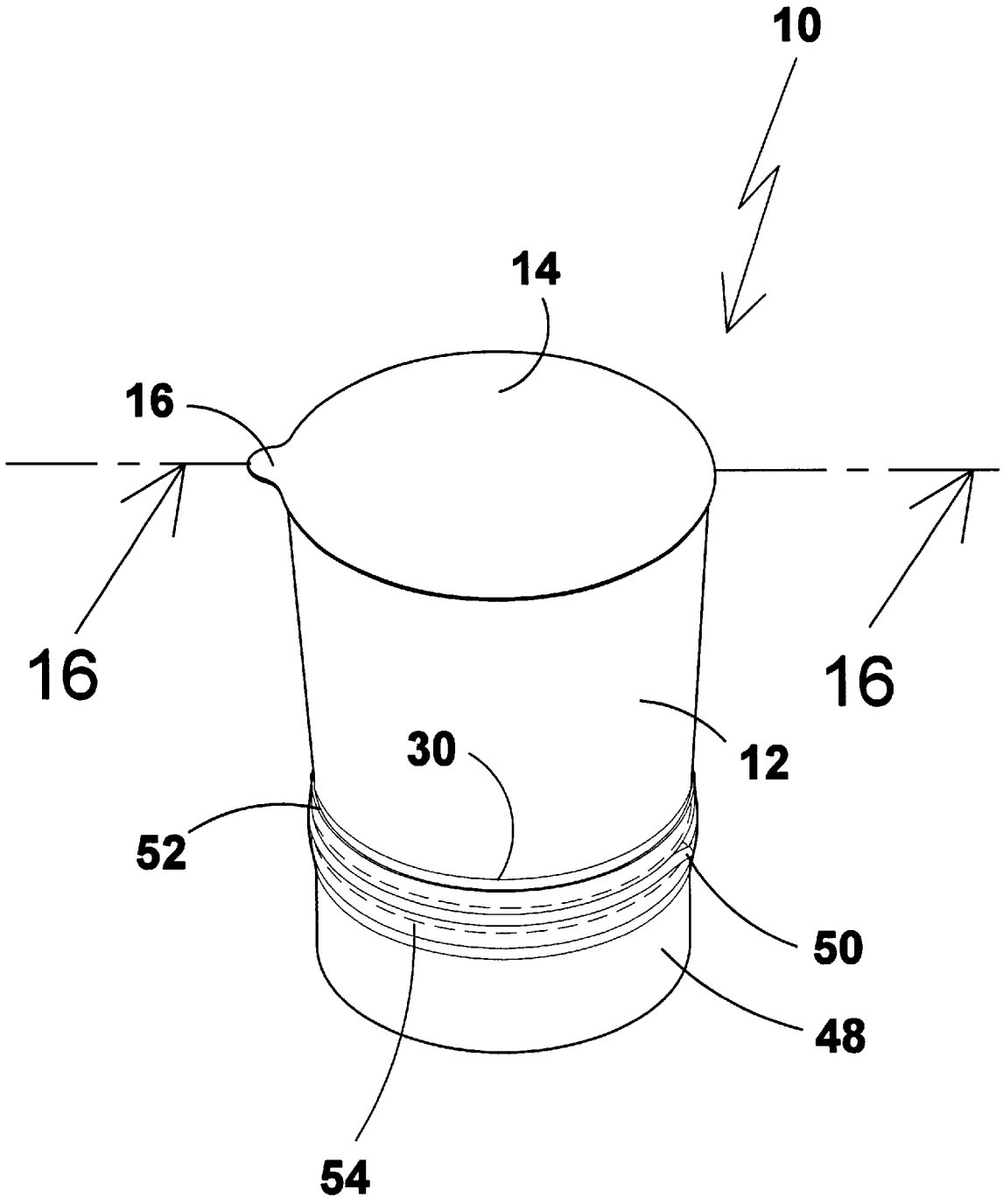
FIG. 13 is a perspective view of the present invention, shown is a cup-like container having a predetermined amount of water hermetically sealed within said container having a releasable seal having a pull tab for removing said seal.

Turning to FIG. 13, shown therein is a perspective view of the present invention 10. Shown is a cup-like container 12 having a predetermined amount of water hermetically sealed within the container 12 having a releasable seal 14 having a pull tab 16 for removing the seal 14.

The liquid portion of the container 12 conforms substantially to a cup having removable sealing means 14 to ensure the freshness of the contents and to provide a tamperproof compartment.

The pills are contained in a second cup 48, as shown in the illustration, which is releasably sealed to the underside of base 30 of the liquid cup portion 12, thereby providing a second sanitary useable cup 48 such as may be necessary when dealing with children. The pill cup 48 is releasably attached to the main cup 12 by a tear strip 54 having a pull string 50 releasing member having a plastic tamper proof cover 52.

Figure 14:
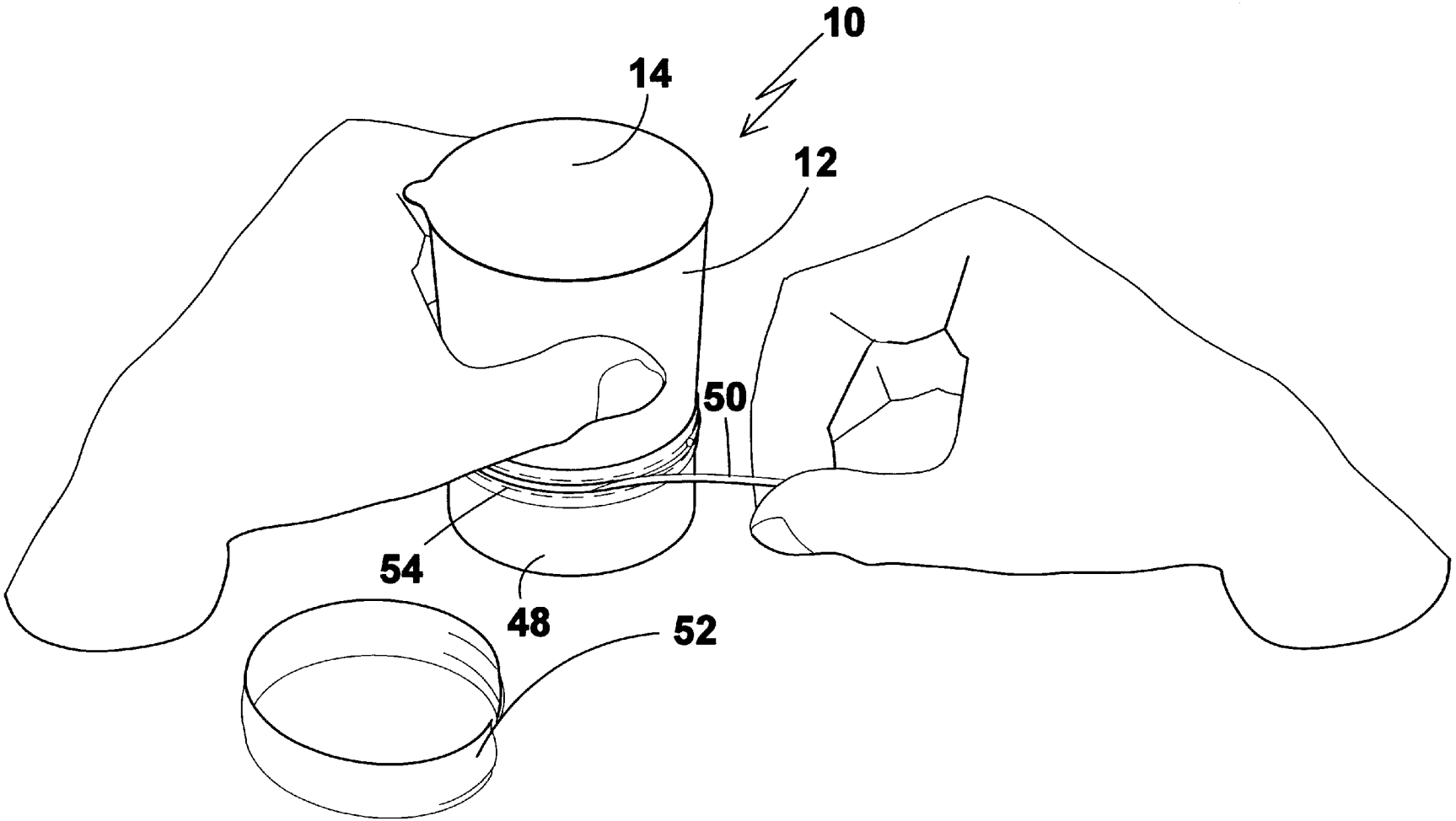
FIG. 14 is a continuation of the illustration as shown in FIG. 13, whereby the present invention having a fluid containing member is releaseably sealed to a second attached cup-like member. Shown is the plastic tamperproof cover removed which provides access to a tear strip which will permit separation of the two cup-like containers and access to the pills contained therein.

Turning to FIG. 14, shown therein is a continuation of the illustration as shown in FIG. 13, whereby the present invention 10 having a fluid containing member 12 is releaseably attached to a second attached cup-like member 48. Shown is the plastic tamperproof cover 52 removed which provides access to a tear strip 54 with pull string 50 which will permit separation in the standard manner of the two cup-like containers 12, 48 and access to the pills contained therein.

Figure 15:
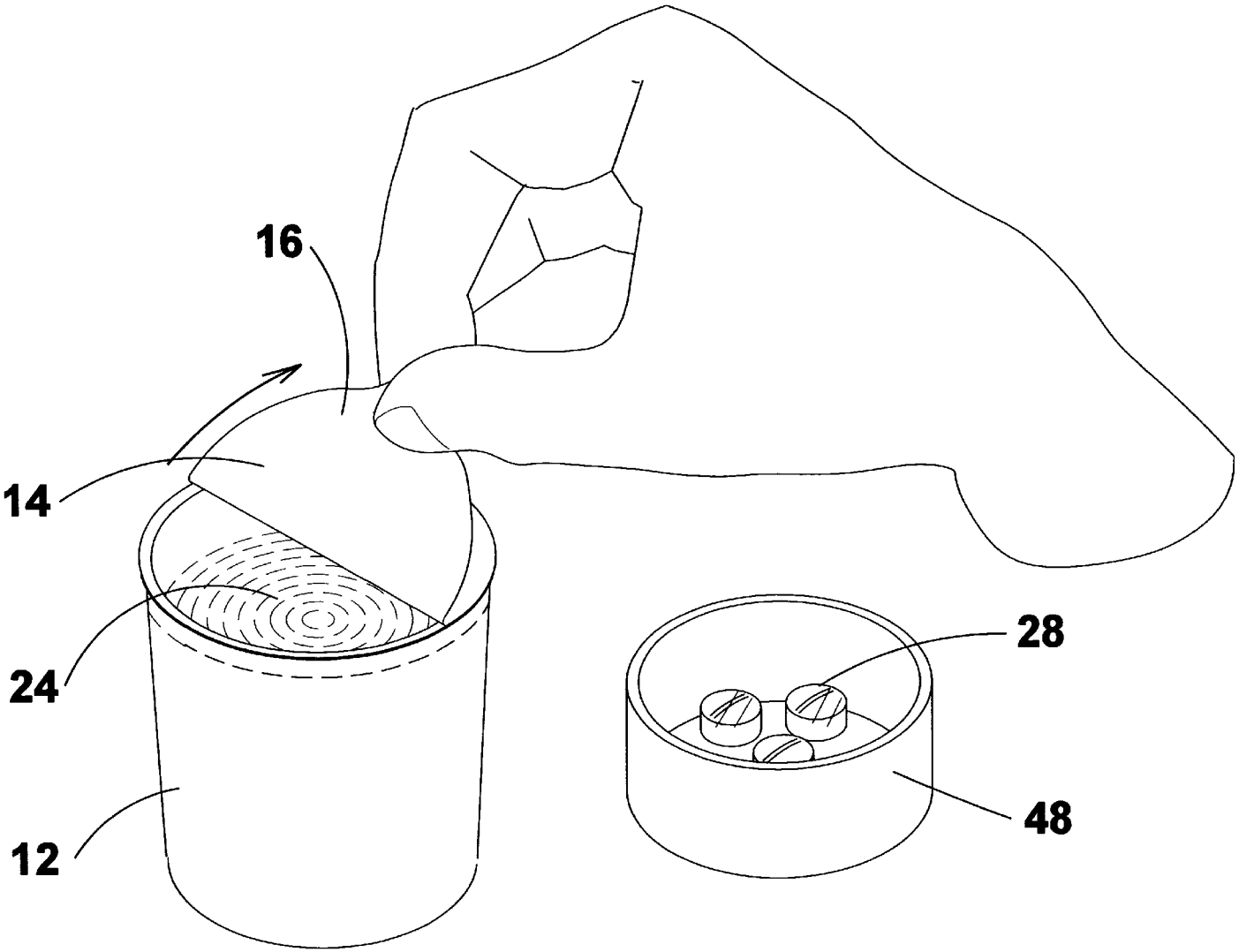
FIG. 15 is a continuation of the illustration as shown in FIG. 14, whereby the attached cup-like containers are separated. One of the cup-like members having a plurality of pills contained therein. Also shown is the hermetically sealed liquid container having the releasable seal being removed by the pull tab providing access to the liquid contained therein.

Turning to FIG. 15, shown therein is a continuation of the illustration as shown in FIG. 14, whereby the attached cup-like containers 12, 48 are separated. One of the cup-like members 48 having a plurality of pills 28 contained therein. Also shown is the hermetically sealed liquid container 12 having the releasable seal 14 being removed by the pull tab 16 providing access to the liquid 24 contained therein.

Figure 16:
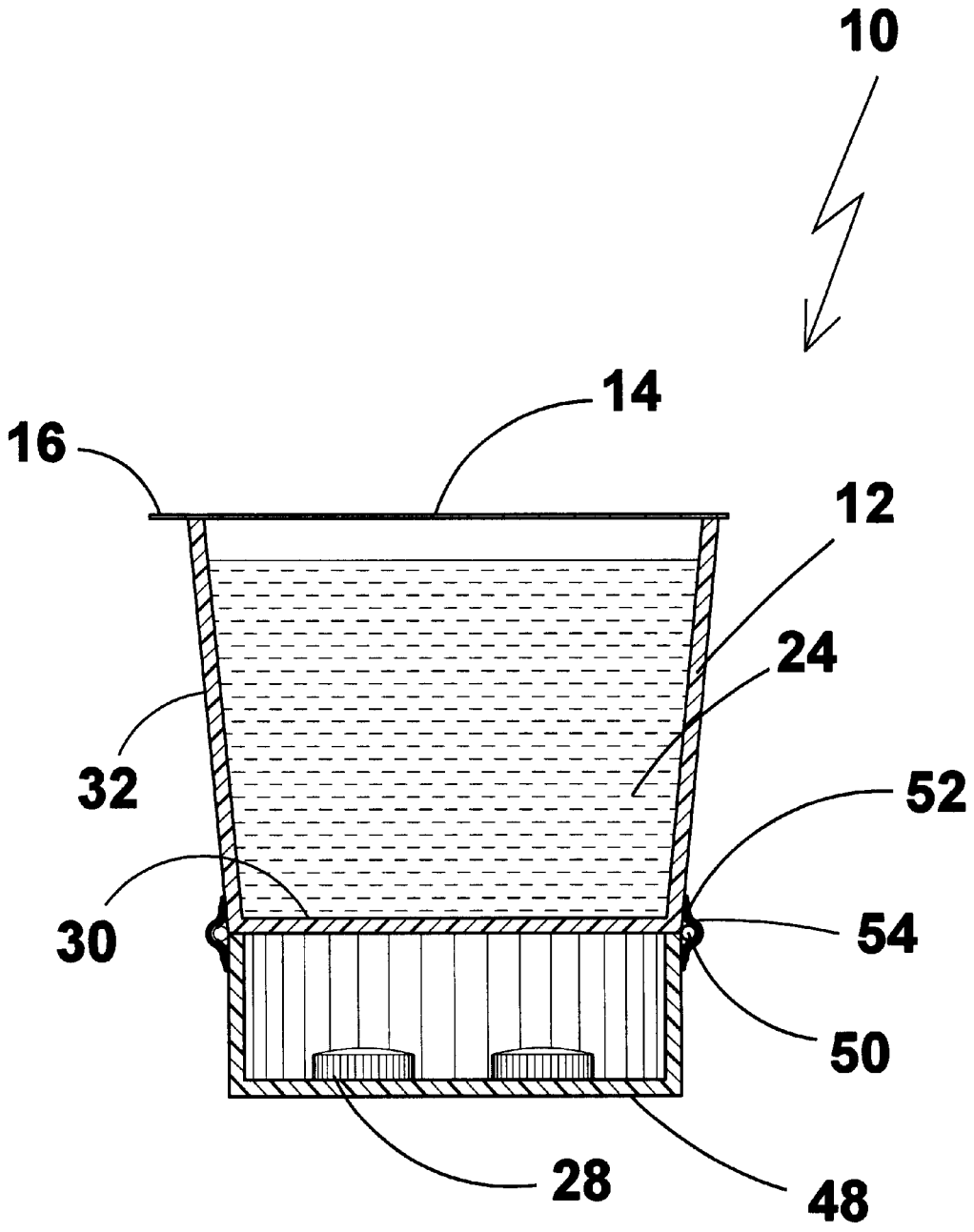
FIG. 16 is a cross sectional view of the present invention taken from FIG. 13 as indicated, showing a hermetically sealed container having a base and side walls for holding a predetermined amount of fluid in a segregated manner from another portion of the container having a plurality of pills contained within a number of cavities.

Turning to FIG. 16, shown therein is a cross sectional view of the present invention 10 taken from FIG. 13 as indicated, showing a hermetically sealed container 12 having a base 30 and side walls 32 for holding a predetermined amount of fluid 24 in a segregated manner from another portion of the container 48 having a plurality of pills 28 contained therein.

The liquid portion of the container 12 has a removable seal 14 having a tab 16 to assist in removal. The removable seal 14 forms a tamperproof seal as well as insuring the freshness of the liquid.

Also shown is the tamper proof cover 52, having a tear strip 54 for releasable attachment of cups 12, 48 and pull string 50.

Figure 17:
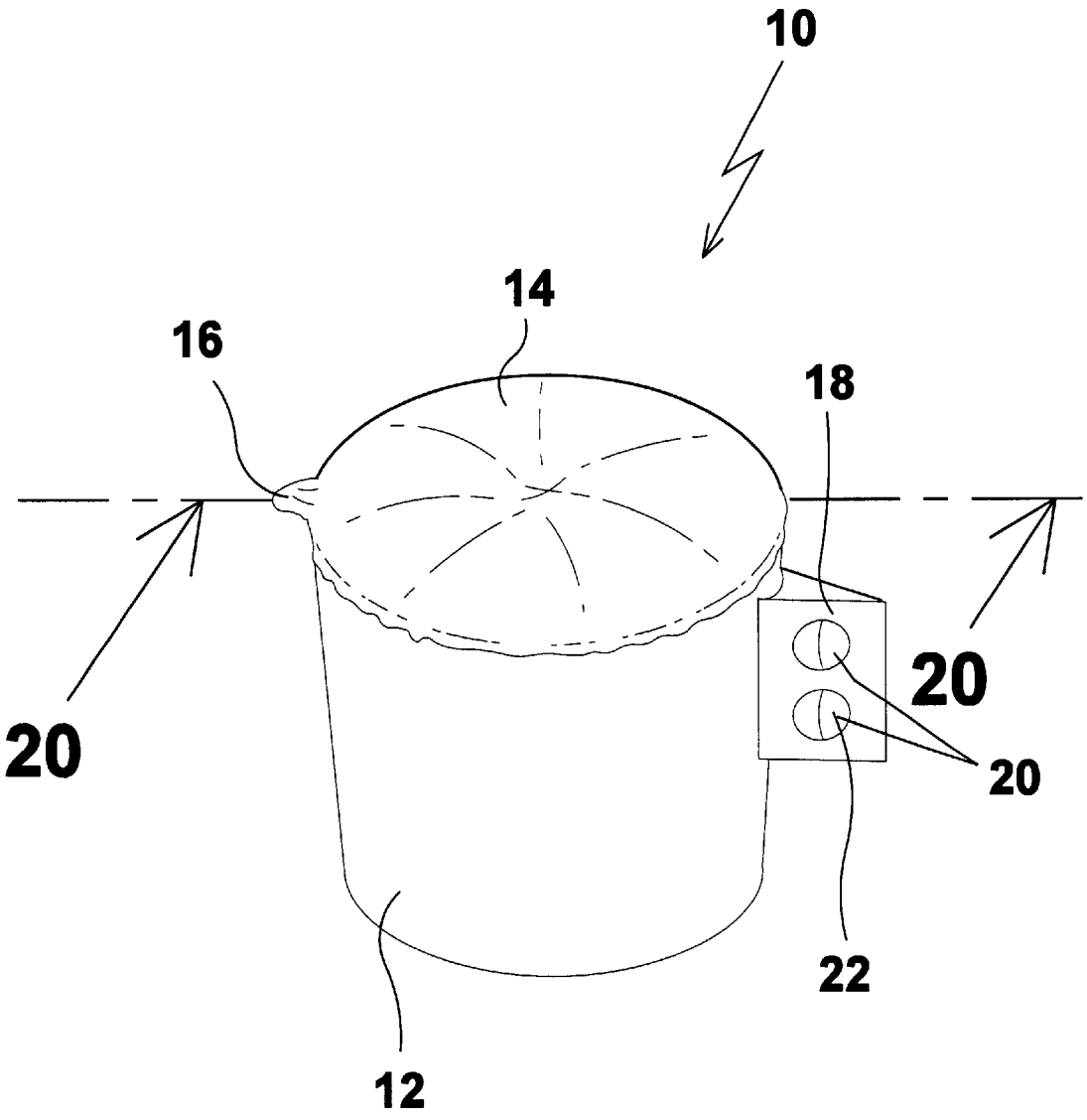
FIG. 17 is a perspective view of the present invention, shown is a cup-like container having a predetermined amount of water hermetically sealed within said container having a releasable seal having a pull tab for removing said seal. Also shown is a handle member forming an integral part of said cup-like container having a plurality of pills contained within cavities within said handle. Said cavities are covered by a material which protects the pills until desired use whereupon finger pressure upon the material will provide access to the pill within said cavity.

Turning to FIG. 17, shown therein is a perspective view of the present invention 10. Shown is a cup-like container 12 having a predetermined amount of water hermetically sealed within the container 12 having a fixably releasable seal 14 made of foil or the like having a pull tab 16 for removing the seal 14. Also shown is a handle member 18 forming an integral part of the cup-like container 12 having a plurality of pills contained or housed within cavities 20 within said handle. The cavities 20 are covered by a sealing material 22 which forms a blister pack or the like over the pills and thereby protects the pills until desired use whereupon finger pressure from the user upon the material 22 will provide access in the standard manner to the pill within the cavity 20.

Figure 18:
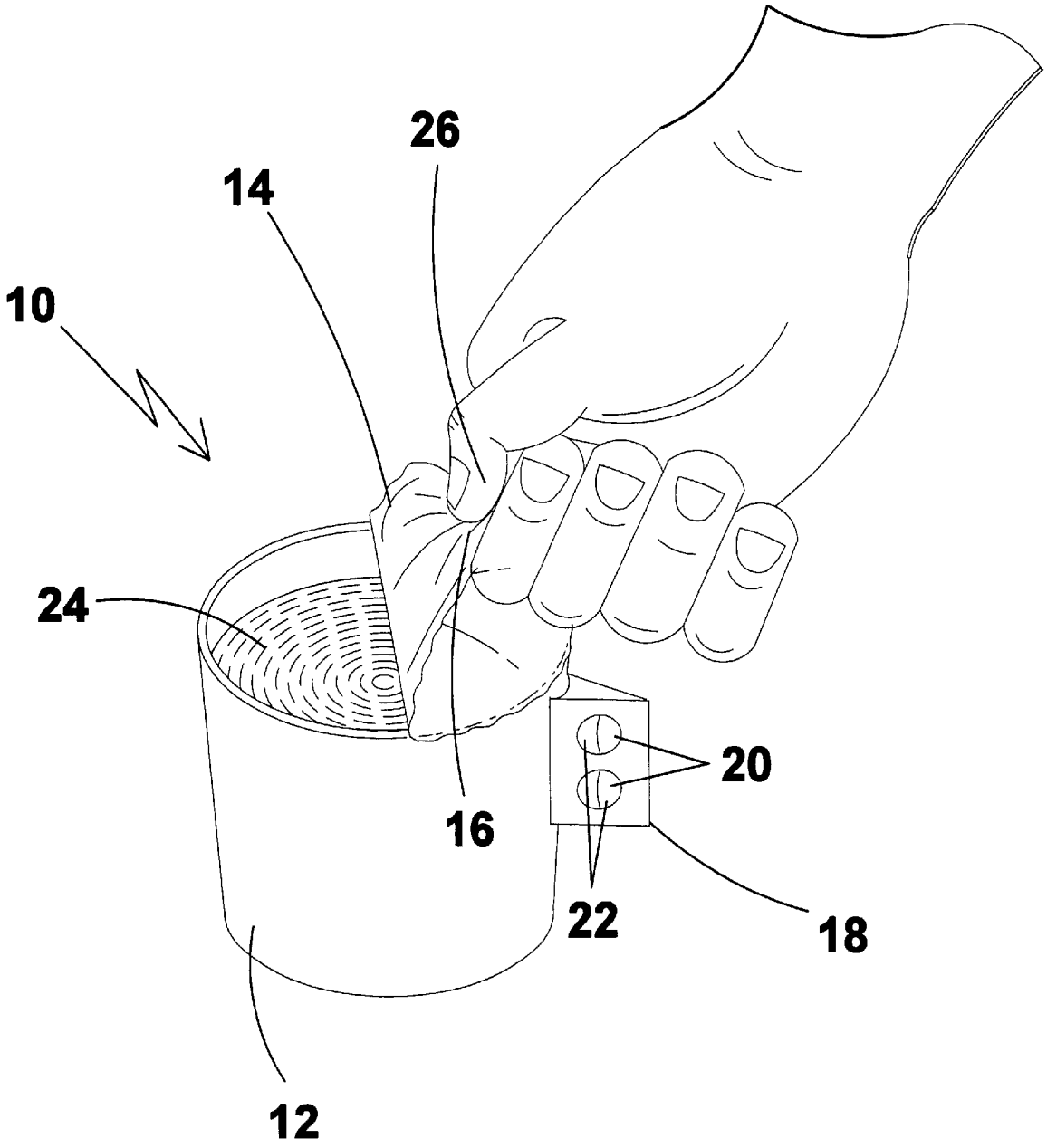
FIG. 18 is an illustrative view of the present invention, as shown in FIG. 17, showing the hermetically sealed liquid container having the releasable seal being removed by the pull tab providing access to the liquid contained therein. Also shown is a handle member forming an integral part of said cup-like container having a plurality of pills contained within cavities within said handle. Said cavities are covered by a material which protects the pills until desired use whereupon finger pressure upon the material will provide access to the pill within said cavity.

Turning to FIG. 18, shown therein is an illustrative view of the present invention 10, as shown in FIG. 17, showing the hermetically sealed liquid container 12 having the releasable seal 14 being removed by the pull tab 16 by the fingers 26 of the hand of the user providing access to the liquid 24 contained therein. Also shown is a handle member 18 forming an integral part of the cup-like container 12 having a plurality of pills contained within cavities 20 within the handle 18. The cavities 20 are covered by a material 22 forming a blister pack or the like which protects the pills until desired use whereupon finger 26 pressure upon the material 22 will provide access to the pill within the cavity 20.

Figure 19:
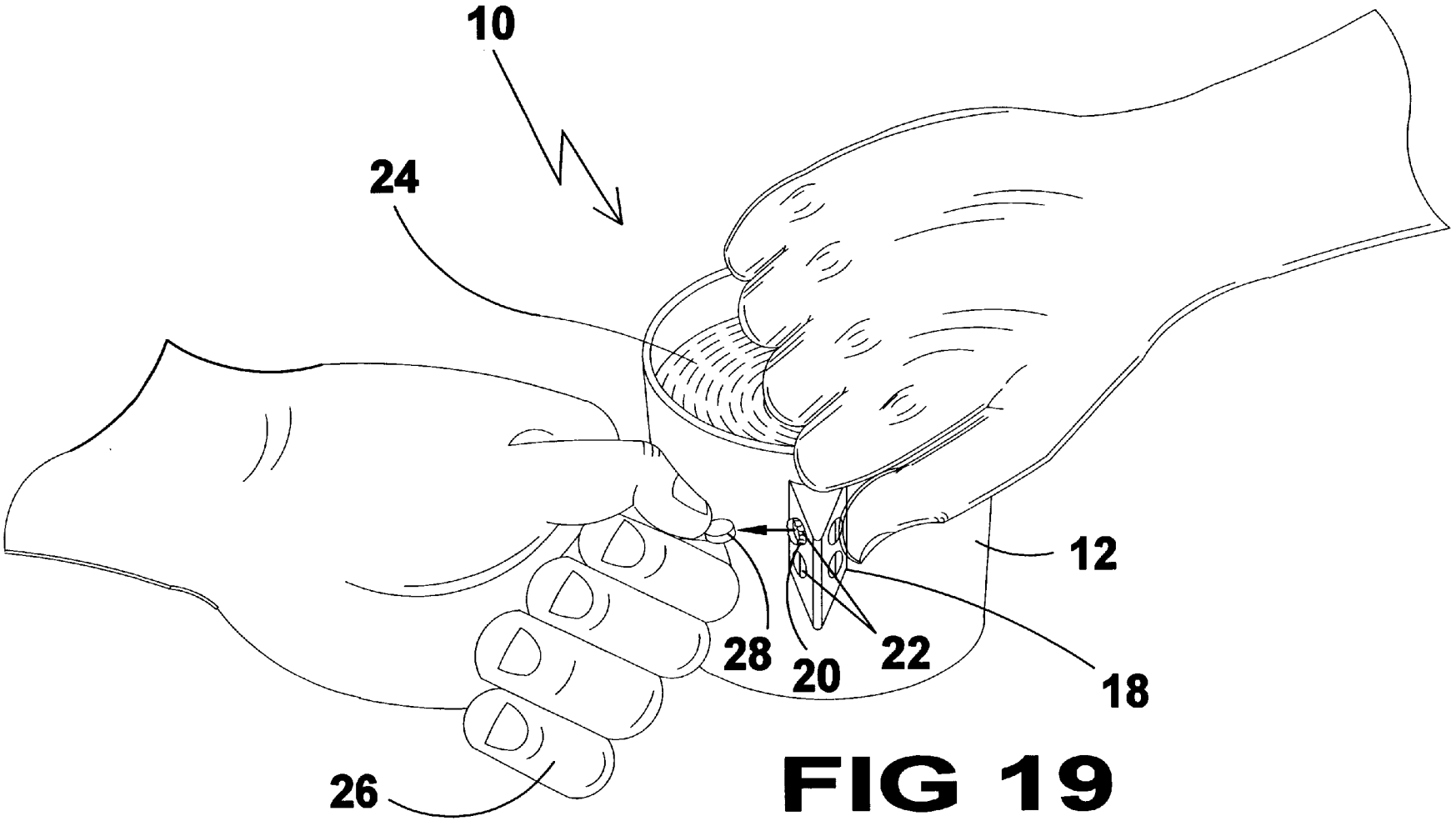
FIG. 19 is continued illustrative view of the present invention, as shown in FIG. 18, showing the hermetically sealed liquid container having the releasable seal being removed by the pull tab thereby providing access to the liquid contained therein. Also shown is a pill removed from a cavity within the handle member which forms an integral part of said cup-like container. Said cavities are covered by a material which protects the pills until desired use whereupon finger pressure upon the trial will provide access to the pill within said cavity.

Turning to FIG. 19, shown therein is continued illustrative view of the present invention 10, as shown in FIG. 18, showing the hermetically sealed liquid container 12 having the releasable seal being removed by the pull tab thereby providing access to the liquid 24 contained therein. Also shown is a pill 28 removed from a cavity 20 within the handle member 18 which forms an integral part of the cup-like container 12. The cavities 20 are covered by a material 22 which protects the pills 28 until desired use whereupon finger pressure 26 upon the material 22 of the blister pack or the like will provide access to the pill 28 within the cavity 20.

Figure 20:
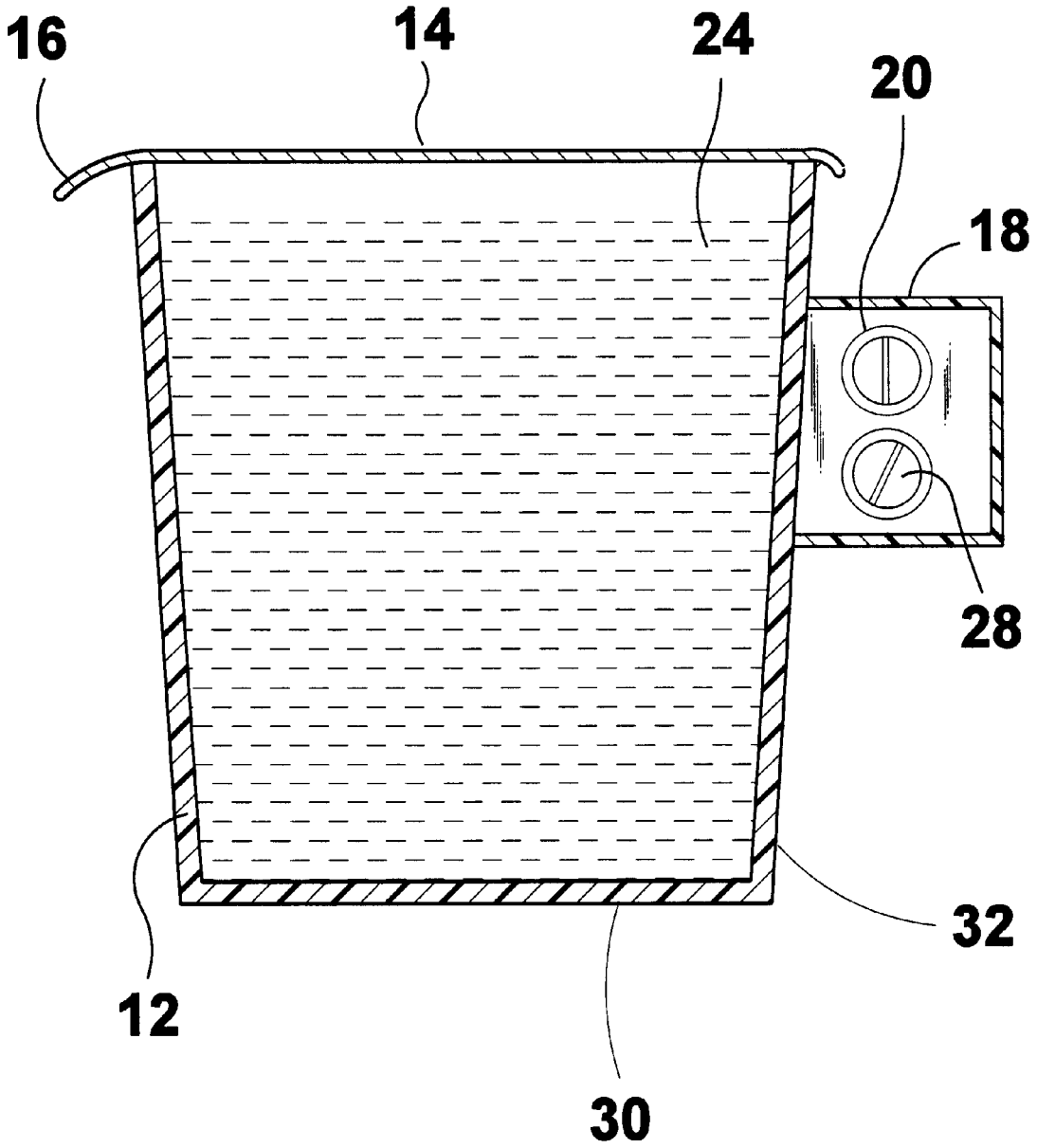
FIG. 20 is a cross sectional view of the present invention taken from FIG. 17 as indicated, showing a hermetically sealed container having a base and side walls for holding a predetermined amount of fluid in a segregated manner from another portion of the container having a plurality of pills contained within a number of cavities.

Turning to FIG. 20, shown therein is a cross sectional view of the present invention taken from FIG. 17 as indicated, showing a hermetically sealed container 12 having a base 30 and side walls 32 or holding a predetermined amount of fluid 24 in a segregated manner from another portion of the container 18 having a plurality of pills 28 contained within a number of cavities 20.

The liquid portion of the container 12 has a removable seal 14 having a tab 16 to assist in removal. The removable seal 14 forms a tamperproof seal as well as insuring the freshness of the liquid 24.

The pills 28 can be contained in a variety of ways such as individual blister packs formed within the handle member 18, as shown, whereby pressing on one side of the blister compartment will provide access through the other side in the standard manner.

Figure 21:
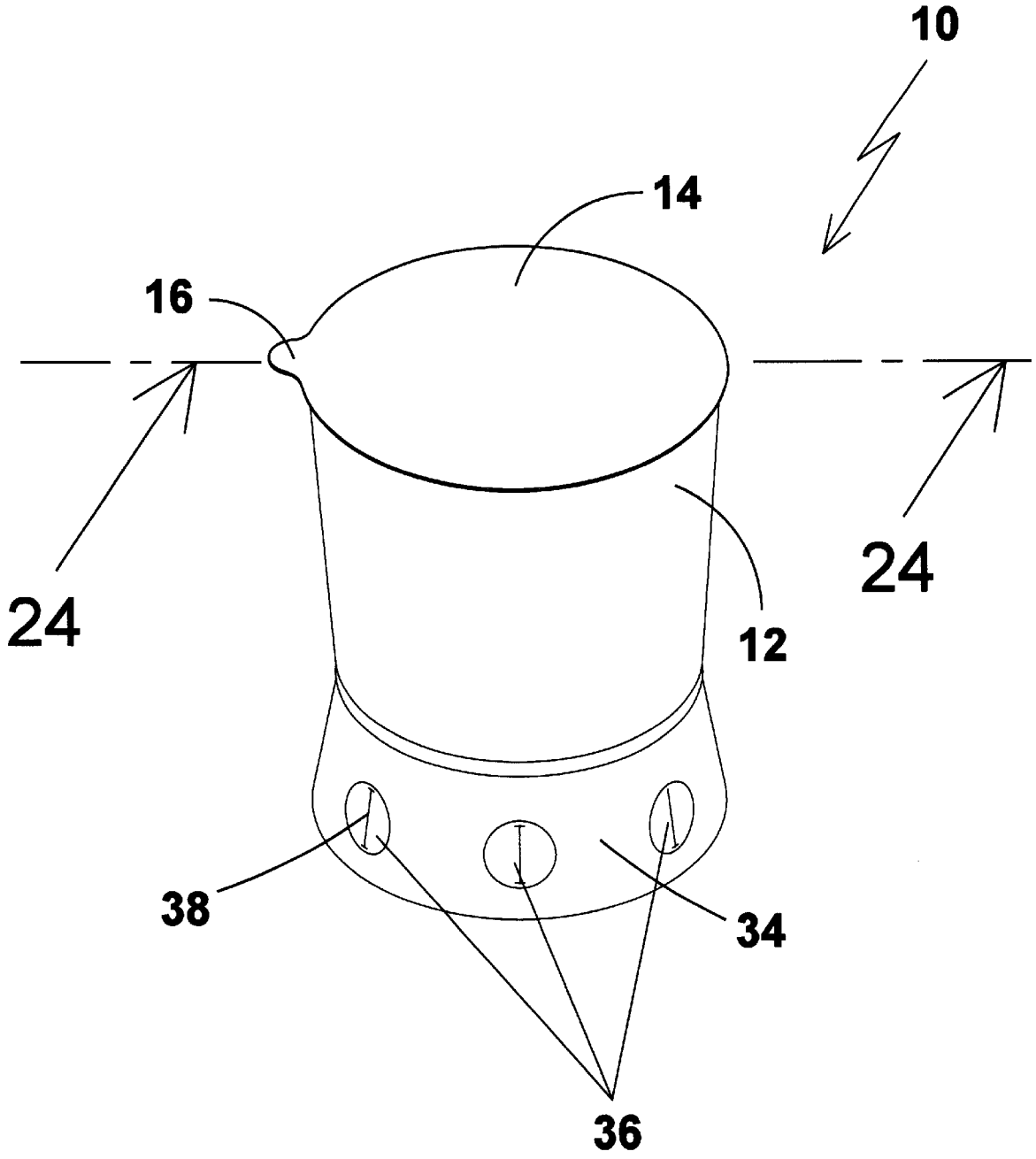
FIG. 21 is a perspective view of the present invention, shown is a cup-like container having a predetermined amount of water hermetically sealed within said container having a releasable seal having a pull tab for removing said seal. Also shown is a flanged base member forming an integral part of said cup-like container having a plurality of pills contained within cavities within said flanged base member. aid cavities are covered by a material which protects the pills until desired use whereupon finger pressure upon the material will provide access to the pill within said cavity.

Turning to FIG. 21, shown therein is a perspective view of the present invention 10. Shown is a cup-like container 12 having a predetermined amount of water hermetically sealed within said container having a releasable seal 14 having a pull tab 16 for removing the seal 14. Also shown is a flanged base member 34 forming an integral part of the cup-like container 12 having a plurality of pills contained within cavities 36 within the flanged base member 34. The cavities are covered by a material 38 which protects the pills until desired use whereupon finger pressure upon the material will provide access to the pill within the cavity 36.

Figure 22:
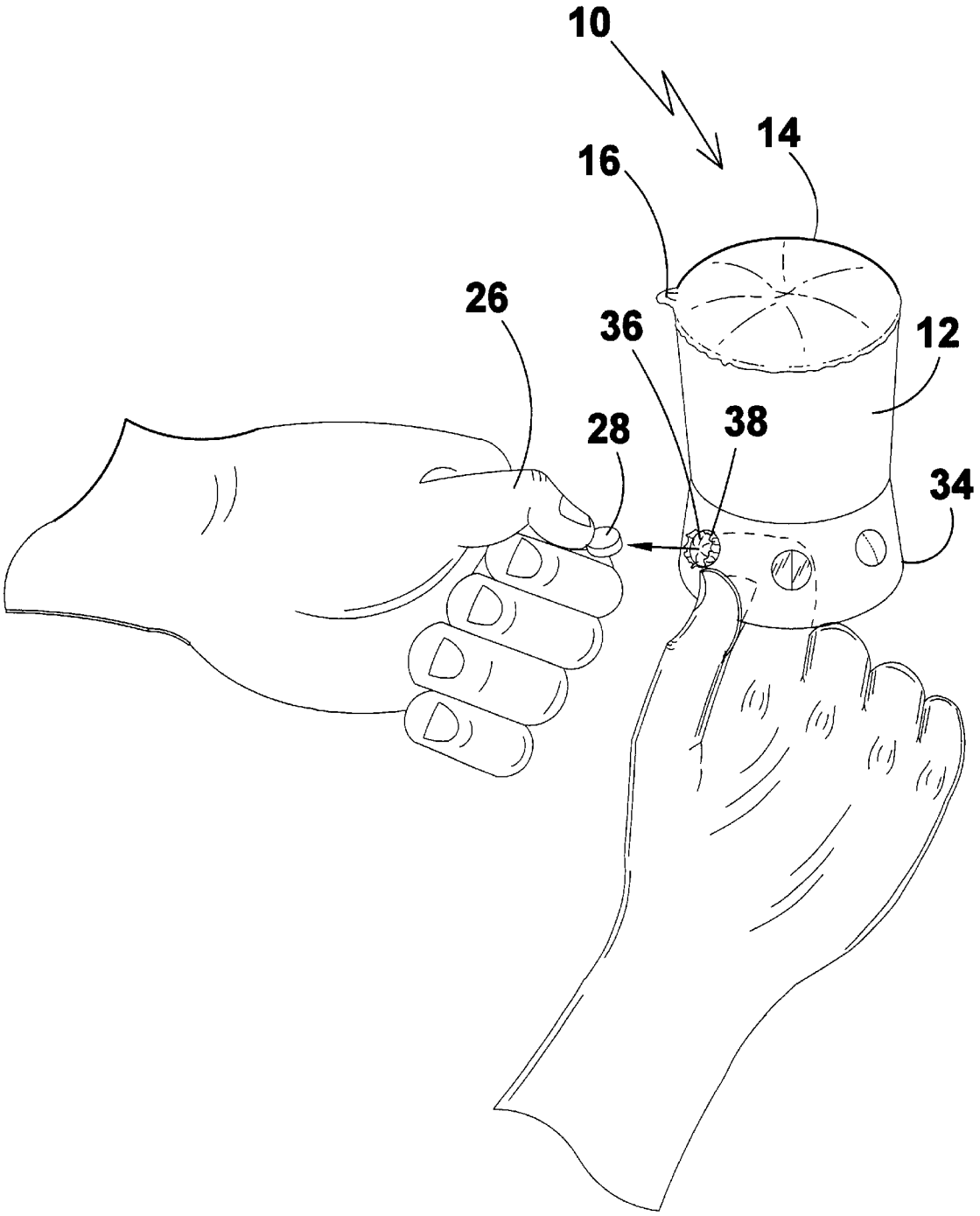
FIG. 22 is continued illustrative view of the present invention, as shown in FIG. 21, showing the hermetically sealed liquid container having the releasable seal having a pull tab thereby providing access to the liquid contained therein. Also shown is a pill removed from a cavity within the flanged base member which forms an integral part of said cup-like container. Said cavities are covered by a material which protects the pills until desired use whereupon finger pressure upon the material will provide access to the pill within said cavity.

Turning to FIG. 22, shown therein is continued illustrative view of the present invention 10, as shown in FIG. 21, showing the hermetically sealed liquid container 12 having the releasable seal 14 having a pull tab 16 thereby providing access to the liquid contained therein. Also shown is a pill 28 removed from a cavity 36 within the flanged base member 34 which forms an integral part of the cup-like container 12. The cavities 36 are covered by a material 38 forming a blister pack or the like which protects the pills 28 until desired use whereupon finger pressure 26 upon the material 38 will provide access to the pill 28 within the cavity 36.

Figure 23:
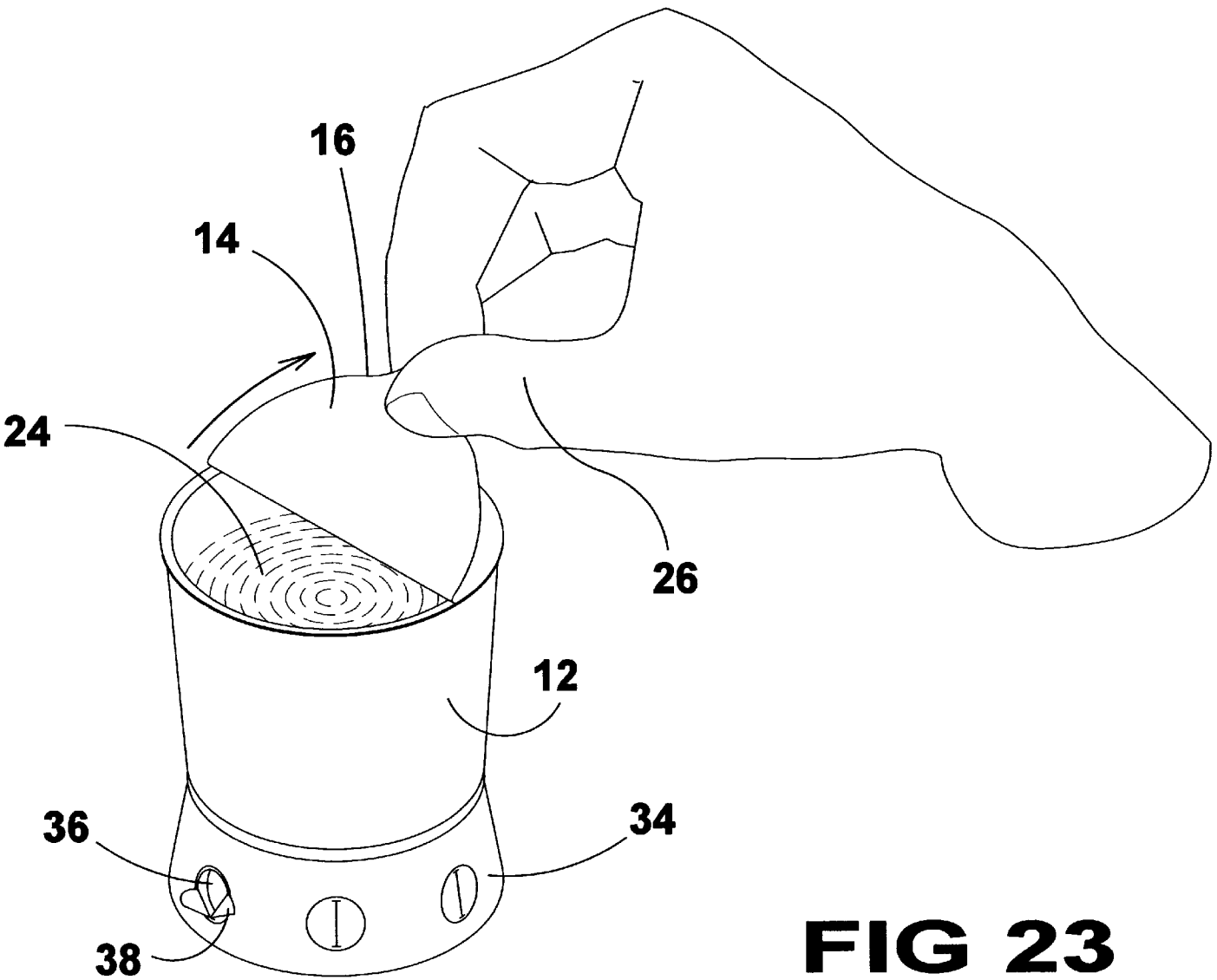
FIG. 23 is a continuation of the illustration shown in FIG. 22, showing the hermetically sealed liquid container having the releasable seal being removed by the pull tab providing access to the liquid contained therein. Also shown is the flanged skirt which forms an. integral part of said cup-like container having a plurality of pills contained within cavities within said skirt. Said cavities are covered by a material which protects the pills until desired use whereupon finger pressure upon the material will provide access to the pill within said cavity.

Turning to FIG. 23, shown therein is a continuation of the illustration shown in FIG. 22, showing the hermetically sealed liquid container 12 having the releasable seal 14 being removed by the pull tab 16 providing access to the liquid 24 contained therein. Also shown is the flanged skirt 34 which forms an integral part of the cup-like container 12 having a plurality of pills contained within cavities 36 within the skirt 34. The cavities 36 are covered by a material 38 which protects the pills until desired use whereupon finger pressure 26 upon the material will provide access to the pill within the cavity 36.

Figure 24:
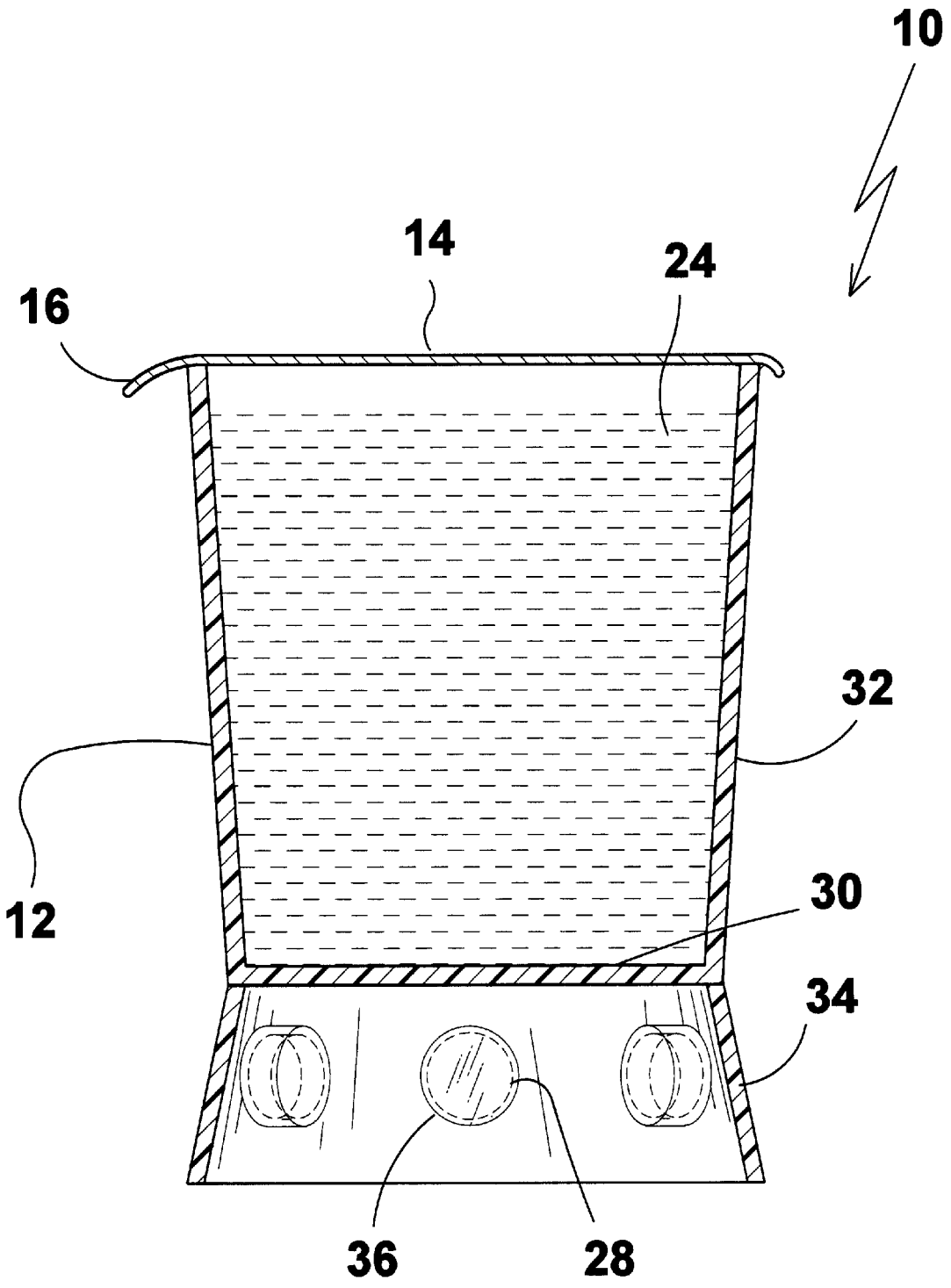
FIG. 24 is a cross sectional view of the present invention taken from FIG. 21 as indicated, showing a hermetically sealed container having a base and side walls for holding a predetermined amount of fluid in i segregated manner from another portion of the container having a plurality of pills contained within a number of cavities.

Turning to FIG. 24, shown therein is a cross sectional view of the present invention 10 taken from FIG. 21 as indicated, showing a hermetically sealed container 12 having a base 30 and side walls 32 for holding a predetermined amount of fluid 24 in a segregated manner from another portion of the container 34 having a plurality of pills 28 contained within a number of cavities 36.

The liquid portion 24 of the container 12 has a removable seal 14 having a tab 16 to assist in removal. The removable seal 14 forms a tamperproof seal as well as insuring the freshness of the liquid 24.

The pills 28 can be contained in a variety of ways such as individual blister packs formed within the handle member, as previously shown, or the pills can be contained in blister packs which are formed in a periphery .flange skirt member 34 whereby pressing the fingers on one side of the blister pack will push the pill through the other side in the standard manner.

Figure 25:
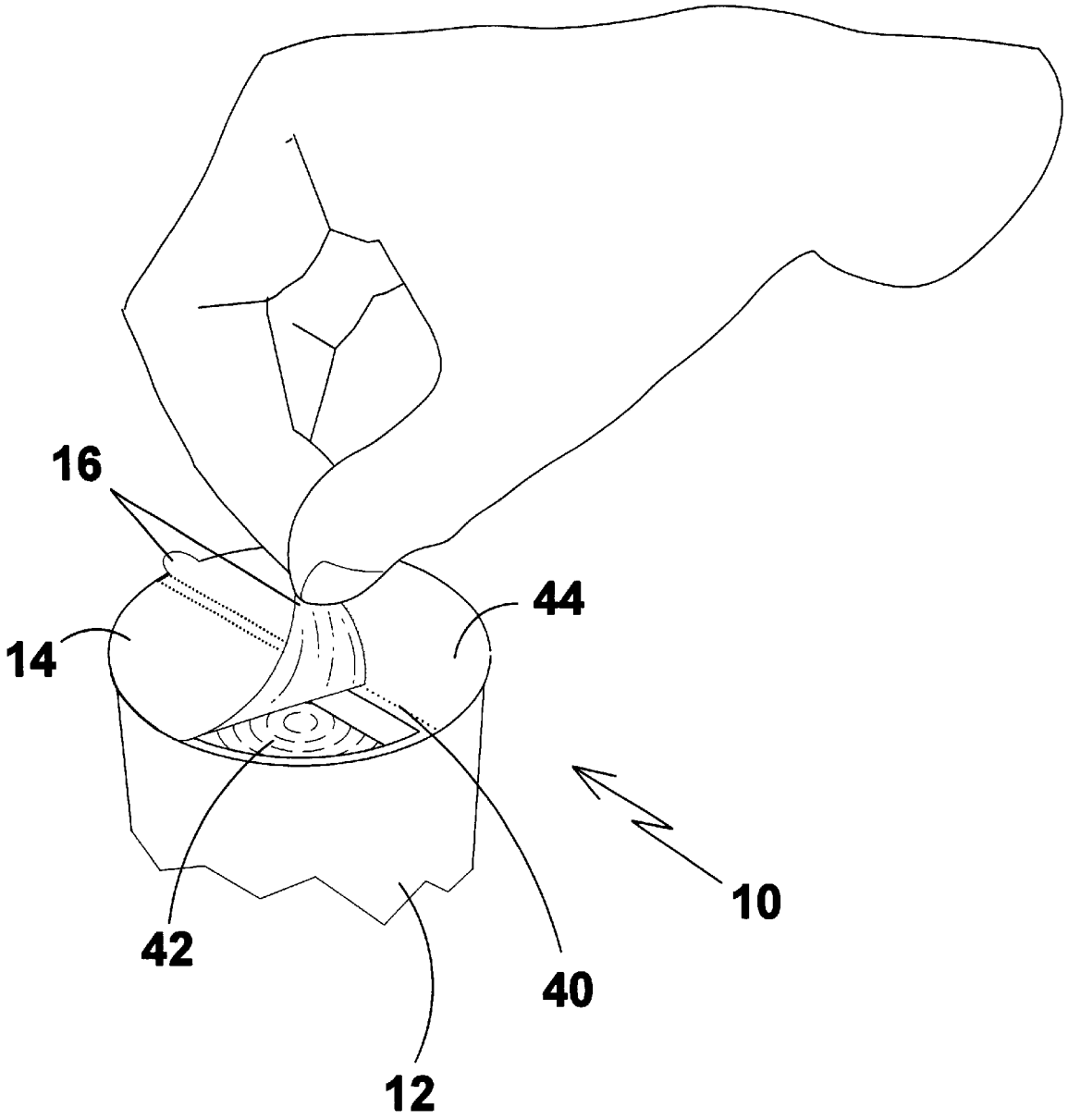
FIG. 25 is a perspective view of the present invention, showing a partial view of the top of the container having an additional element wherein the liquid containing portion has a single partition dividing the container into two independently functional liquid containing sections. Also shown is the resealable seal formed and functioning in two parts each section having a pull tab providing access to a single fluid containing section.

Turning to FIG. 25, shown therein is a perspective view of the present invention 10, showing a partial view of the top of the container 12 having an additional element wherein the liquid containing portion has a single vertical partition 40 dividing the container into two independently functional liquid containing sections 42, 44. Also shown is the resealable seal 14 formed and functioning in two parts corresponding to sections 42, 44 each section having a pull tab 16 providing access to a single fluid containing section.

Figure 26:
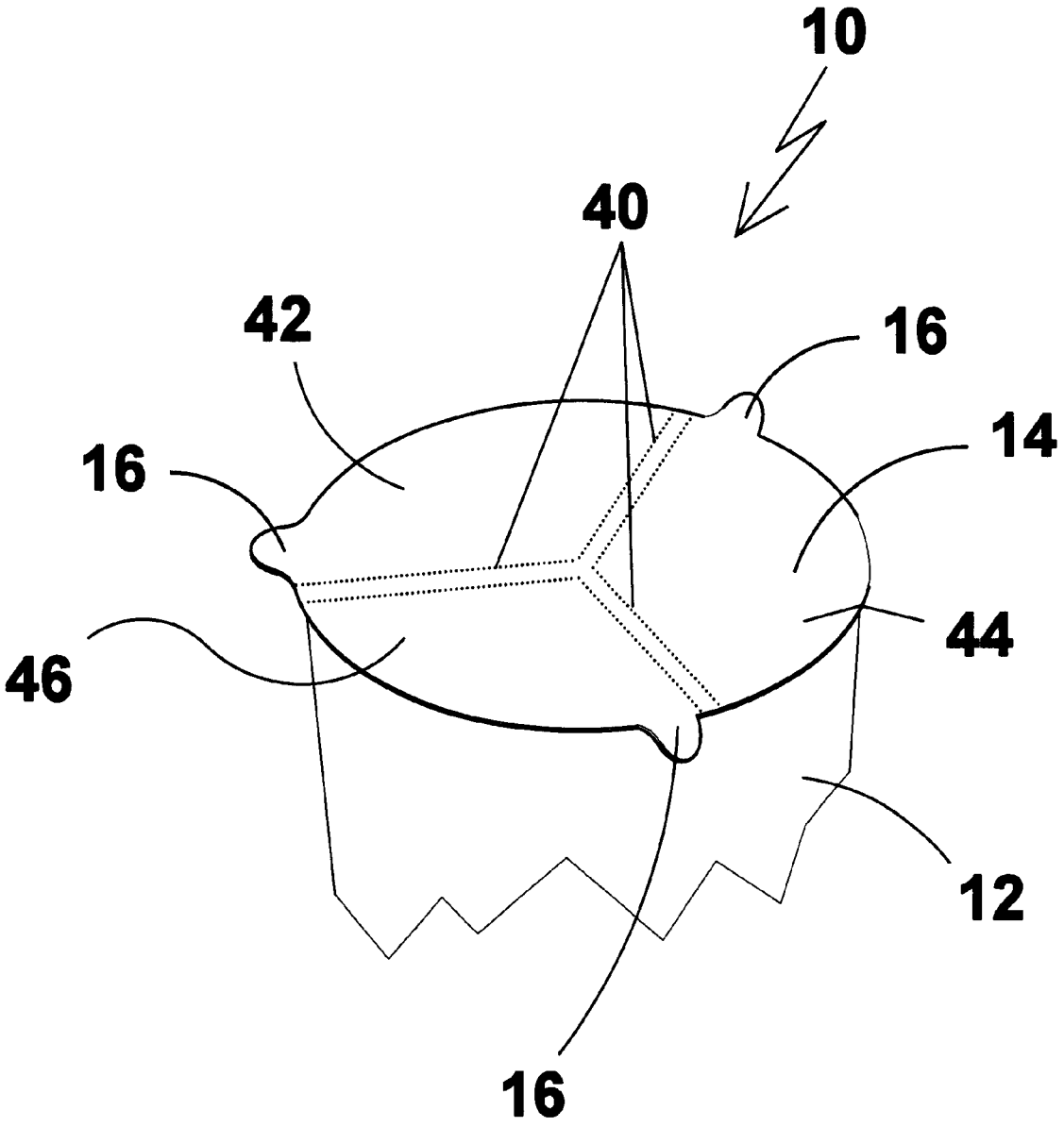
FIG. 26 is a perspective view of the present invention, showing a partial view of the top of the container having an additional element wherein the liquid containing portion has a plurality of partitions dividing the container into a plurality of independently functional liquid containing sections. Also shown is the resealable seal formed and functioning in a plurality of parts each section having a pull tab providing access to a single fluid containing section.

Turning to FIG. 26, shown therein is a perspective view of the present invention 10, showing a partial view of the top of the container 12 having an additional element wherein the liquid containing portion has a plurality of vertical partitions 40 dividing the container into a plurality of independently functional liquid containing sections 42, 44, 46. Also shown is the resealable seal 14 formed and functioning in a plurality of parts corresponding to sections 42, 44, 46 each section having a pull tab 16 providing access to a single fluid containing section.

What is claimed to be new and desired to be protected by Letters Patent is set forth in appended claims.

I claim:

1. An apparatus for dispensing medication and fluid for oral consumption therewith, comprising:

a) a package consisting of a pair of shells, said shells having opposing concavities, said shells being heat sealed along the edges of said shells, said package thereby being closed;

b) a pair of upper and lower chambers formed in said package;

c) a heat sealed divide disposed between said pair of chambers;

d) said lower chamber for receiving the medication;

e) said upper chamber for receiving the fluid for oral consumption of the medication;

f) a first tear away strip at a lower end of said lower chamber for entry into said lower chamber to obtain access to said medication;

g) a thin rigid wire folded flat near an upper end of said upper chamber; and h) a second tear strip above said wire which opens to a circular configuration when said second tear strip is removed forming a cup-like opening allowing a user to drink the fluid within said upper chamber when taking said medication.

2. The apparatus of claim 1, wherein said package is made of plastic.

3. The apparatus of claim 1, wherein said package is disposable.

* * * * *